US009597896B2

(12) United States Patent
Ikeda

(10) Patent No.: US 9,597,896 B2
(45) Date of Patent: Mar. 21, 2017

(54) HANDHELD RECORDING DEVICE, RECORDING DEVICE POSITION DETECTION METHOD, AND RECORDING MEDIUM

(71) Applicant: Naoto Ikeda, Kanagawa (JP)

(72) Inventor: Naoto Ikeda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/991,190

(22) Filed: Jan. 8, 2016

(65) Prior Publication Data

US 2016/0214375 A1 Jul. 28, 2016

(30) Foreign Application Priority Data

Jan. 27, 2015 (JP) ..... 2015-013399

(51) Int. Cl.
*B41J 3/36* (2006.01)

(52) U.S. Cl.
CPC ..... *B41J 3/36* (2013.01)

(58) Field of Classification Search
CPC ..... B41J 3/36; B41J 2/04545
USPC ..... 347/14, 19, 109
See application file for complete search history.

(56) References Cited

U.S. PATENT DOCUMENTS 5,927,872 A * 7/1999 Yamada ..... B41J 2/36 400/88
6,806,453 B1 * 10/2004 Vincent ..... B41J 3/4076 235/472.01
7,914,096 B2 * 3/2011 Hagiwara ..... B41J 2/2135 347/14

FOREIGN PATENT DOCUMENTS

JP 2010-520087 6/2010
JP 2012-198607 10/2012
WO WO2008/109550 A1 9/2008

* cited by examiner

*Primary Examiner* — Julian Huffman
*Assistant Examiner* — Sharon A Polk
(74) *Attorney, Agent, or Firm* — Cooper & Dunham LLP

(57) ABSTRACT

A handheld recording device includes a recording head, at least two navigation sensors arranged at a predetermined mounting distance, a timing generating circuit to generate a timing signal while the recording device is scanning a recording medium, a controller to determine position information of the recording device, and a drive circuit to drive the recording head to eject ink to perform recording on the recording medium using the position information. The controller reads output values of the two navigation sensors every time the timing signal is generated, determines whether the output values include noise, removes noise from the output values when it is determined that at least one of the output values includes noise, and calculates an amount of movement of the recording head to determine the position information based on the output values from which noise has been removed.

11 Claims, 17 Drawing Sheets

HANDHELD RECORDING DEVICE, RECORDING DEVICE POSITION DETECTION METHOD, AND RECORDING MEDIUM

CROSS-REFERENCE TO RELATED APPLICATIONS

This patent application is based on and claims priority pursuant to 35 U.S.C. §119(a) to Japanese Patent Application No. 2015-013399, filed on Jan. 27, 2015, in the Japan Patent Office, the entire disclosure of which is hereby incorporated by reference herein.

BACKGROUND

Technical Field

The present invention relates to a handheld recording device, a position detection method, and a non-transitory recording medium storing a position detection control program.

Description of the Related Art

Printers, an example of recording devices, employ various recording systems, such as inkjet printers, laser printers, thermal printers, and dot impact printers. In recent years, inkjet printers are widely used as small printers.

An inkjet printer is a recording device that forms a desired image, such as characters, figures, or photographs, by applying ink, which is a recording agent, on a sheet of paper, which is a recording medium. Application of ink is generally performed while reciprocating an inkjet head along a guide rail in a certain direction (main-scanning direction) and conveying a sheet of paper, which is a recording medium, in a sub-scanning direction.

Due to the size reduction of notebook personal computers (PCs) and the rapid spread of smart devices such as smart phones, there has been an increasing demand for reducing the size of a printer so as to be easily portable.

In order to meet the demand, a handheld printer is proposed, which records an image by applying ink while scanning a recording medium (print medium) such as a sheet of paper with the use of a human hand.

For example, a position is determined using information obtained by navigation sensors, an image is printed on a medium at that position, an image of a medium surface including the printed portion is captured, and the surface image is compared with a print image to correct the position information.

However, in such a handheld recording device (printer), electrically random noise may get mixed in with the position information from the navigation sensors. In that case, the position information from the navigation sensors may be deviated from the actual position, and accordingly no correct position information can be obtained.

SUMMARY

According to one aspect of the present invention, a handheld recording device includes a recording head including a plurality of nozzles, at least two navigation sensors arranged at a predetermined mounting distance in a direction in which the plurality of nozzles are arranged, a timing generating circuit to generate a timing signal with a predetermined sampling period while the handheld recording device is scanning a recording medium, a controller to determine position information of the recording device, and a drive circuit to drive the plurality of nozzles to eject ink to perform recording on the recording medium in accordance with image data and the determined position information. The controller reads output values of the two navigation sensors every time the timing signal is generated, determines whether the output values include noise based on the output values and the mounting distance between the two navigation sensors, removes noise from the output values when it is determined that at least one of the output values includes noise, and calculates an amount of movement of the recording head from a reference point to determine the position information, based on the output values from which noise has been removed.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
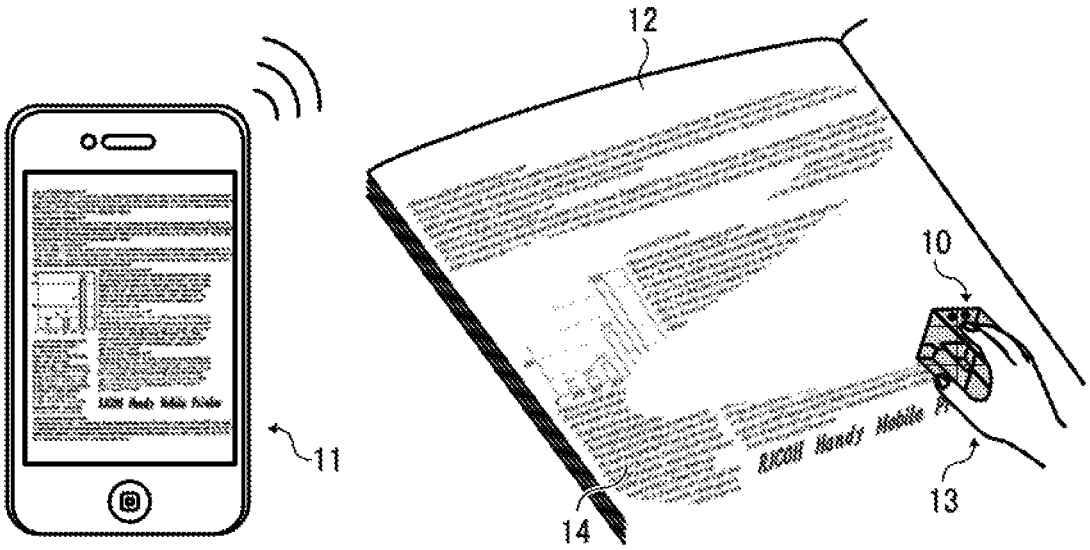
FIG. 1 is a diagram illustrating an exemplary configuration of a recording system including a handheld printer which is an embodiment of a handheld recording device according to the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or displays.

Hereinafter, an embodiment of the present invention will be specifically described on the basis of the drawings.

FIG. 1 is a diagram illustrating an exemplary configuration of a recording system including a handheld printer which is an embodiment of a handheld recording device according to the present invention.

A handheld printer 10 is a handheld recording device whose size and weight make it easy for a person to carry in one hand. The handheld printer 10 can form an image on a recording medium 12 such as a notebook or standard paper by freely moving on and scanning the recording medium 12. The handheld printer 10 is also called a handy mobile printer.

The handheld printer 10 is an inkjet printer that includes a recording head having a row of plural nozzles, ejects ink from the nozzles in accordance with image data, and forms an image on the recording medium 12. The handheld printer 10 may be a monochrome printer or a color printer.

In addition, the handheld printer 10 receives image data from a smart device 11 serving as a host device that holds image data, through wireless communication such as infrared communication, Bluetooth (registered trademark), or WiFi. On the basis of the received image data, the handheld printer 10 forms an image on the recording medium 12.

The image data may be text data that only includes characters, document data including figures, pictures, and photographs, table data, or the like. The handheld printer 10 may directly receive the image data from the smart device 11 or may receive the image data via an access point or the like. Instead of using wireless communication, the handheld printer 10 may be connected to the smart device 11 via a cable or the like, and the handheld printer 10 may receive the image data through wired communication.

The smart device 11 is an information processing device (host device) such as a smart phone, a tablet terminal, or a notebook PC, and transmits image data held therein to the handheld printer 10 by performing wireless or wired communication with the handheld printer 10. In addition, the smart device 11 can transmit image data received and obtained from another device such as a server to the handheld printer 10.

The smart device 11 includes a memory that stores image data, an application that displays the image data, an operating system (OS) and the like, a central processing unit (CPU) that executes the application, a display that displays an image, and an input device that inputs an instruction to print the image. The display and the input device are not limited to those configured as separate devices, and may be a touchscreen that includes both of these functions. Here, the term "print" has the same meaning as the term "record" which means forming and recording an image on a recording medium (print medium) such as a sheet of paper.

The user turns on the power of the smart device 11, activates the application, and displays image data. When the user wants to print the image data, the user instructs to print by, for example, tapping a print start key displayed on the touchscreen. On receipt of the print instruction, the smart device 11 transmits the image data to the handheld printer 10 by performing wireless communication.

The handheld printer 10 receives the image data, which is to be printed, from the smart device 11. The user holds the handheld printer 10 in a hand 13, and moves the handheld printer 10 on the recording medium 12, such as a sheet of paper. In the meantime, the handheld printer 10 calculates the position of each nozzle of the recording head as a coordinate position with reference to an initial position determined in the beginning.

In the case where the coordinate position of data (print data) of image elements configuring the received image data matches the calculated coordinate position, the handheld printer 10 sends the print data to a later-described controller that controls the recording head. Under control of the controller, the recording head including the nozzles ejects ink from a nozzle at the coordinate position to perform printing. The handheld printer 10 repeats this operation to form an image 14 on the recording medium 12.

Roughly speaking, there are three types of position detecting functions and scanning methods in such handheld printers:

(1) Having a position detecting function in one direction (such as the X-axis direction), and printing while scanning in this direction;

(2) Having a position detecting function in two directions (such as the X-axis and Y-axis directions), and printing while scanning in these two directions; and (3) Having a position detecting function in three directions (such as the X-axis and Y-axis directions, and a rotation direction regarding the R-axis), and printing while freely scanning (free-hand scanning) on a plane.

The handheld printer 10 according to the embodiment is preferably a printer that uses the above-mentioned method (3).

The handheld printer 10 has a box shape such as that illustrated in FIG. 1, and includes a recording head having a row of plural nozzles for ejecting ink. The handheld printer 10 is used while a face thereof having the nozzles (lower face in FIG. 1) is pressed against the recording medium 12, which has a planar shape.

When the handheld printer 10 is held by the user's hand 13 and pressed against the recording medium 12, the nozzles of the recording head are arranged so that their tips are spaced by a certain distance from the recording medium 12. The distance from the tips of the nozzles to the recording medium 12 is determined in advance as a distance for the nozzles to eject ink to appropriately perform printing.

The user holds the handheld printer 10 in his/her hand 13, presses the recording-head side of the handheld printer 10 against the recording medium 12, scans the recording medium 12 from left to right, moves the handheld printer 10 down one row, and scans the recording medium 12 from right to left, thereby recording (printing) the image 14 on the recording medium 12.

Figure 2:
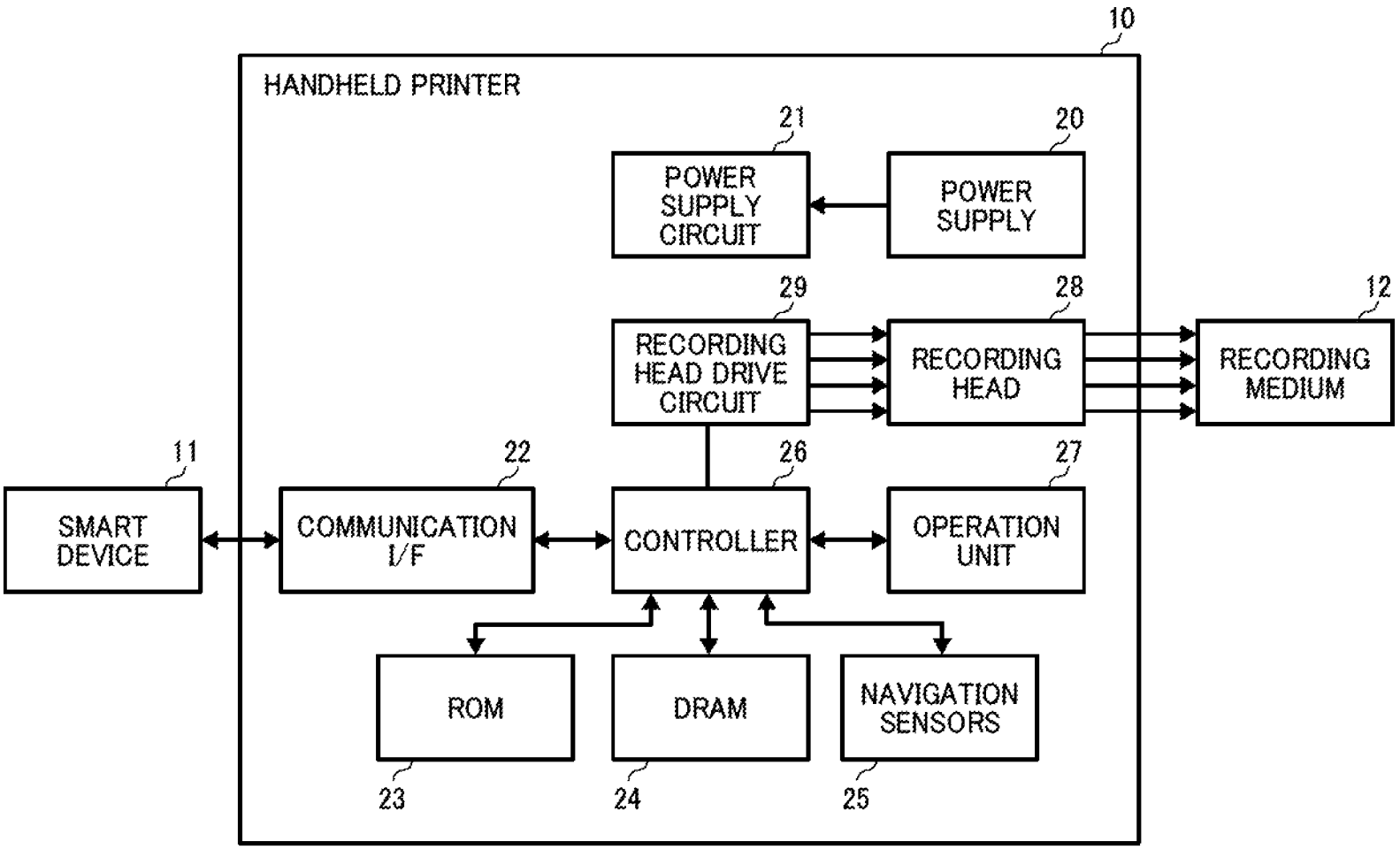
FIG. 2 is a block diagram illustrating the hardware configuration of the handheld printer illustrated in FIG. 1.

FIG. 2 is a block diagram illustrating the hardware configuration of the handheld printer 10 illustrated in FIG. 1.

The handheld printer 10 includes a power supply 20 such as a battery, and a power supply circuit 21 that supplies power from the power supply 20 to each unit. The power supply circuit 21 may include a circuit for charging the battery of the power supply 20, and a switch circuit for switching to/from an alternating current (AC) power supply.

The handheld printer 10 additionally includes a communication interface (IF) 22 that receives image data sent from the smart device 11. The communication interface 22 is preferably a wireless communication unit that communicates in compliance with such as a wireless local area network (LAN), Bluetooth (registered trademark), or near field communication (NFC), but is not limited thereto, and may be a wired communication unit.

The handheld printer 10 further includes a read-only memory (ROM) 23, a dynamic random-access memory (DRAM) 24, navigation sensors 25, a controller 26, an operation unit (OPU) 27, a recording head 28, and a recording head drive circuit 29.

The ROM 23 is a read-only memory that stores firmware that controls the hardware of the handheld printer 10, drive waveform data of the recording head 28, and various types of initial setting data.

The DRAM 24 is used to temporarily store image data received by the communication interface 22, is used as a work memory at the time of firmware operation, and is used to store firmware (program) expanded from the ROM 23.

The navigation sensors 25, the number of which is two or more, are provided across the recording head 28, and the navigation sensors 25 detect coordinate information for calculating position information on the handheld printer 10 and the recording head 28, and a movement distance. The navigation sensors 25 may be used to calculate a rotation amount and an acceleration, in addition to the movement distance (movement amount). The navigation sensors 25 will be described in detail later.

The controller 26 includes a CPU, and controls the entire handheld printer 10. The control performed by the controller 26 will be described in detail later. For example, on the basis of information from the navigation sensors 25, the controller 26 calculates position information on each of the nozzles of the recording head 28, and, in accordance with the position information, selects or determines whether to print an image. The controller 26 also performs control to remove noise.

The operation unit (OPU) 27 includes operation keys and a liquid crystal display (LCD), and may include a touch-screen. The operation unit 27 is able to accept an input from the user and notify the user of the circumstances of the operation, errors, and so forth.

The recording head 28 includes a nozzle row including a plurality of nozzles for ejecting ink. In the embodiment, the recording head 28 includes four nozzle rows for ejecting cyan (C), magenta (M), yellow (Y), and black (K), respectively, thereby performing full-color printing. The nozzles may be either piezoelectric or thermal inkjet nozzles. In the embodiment, the nozzles are piezoelectric inkjet nozzles.

The recording head drive circuit 29 accepts print data for printing, and print timing information for designating a time to start printing. At the time designated by the print timing information, the recording head drive circuit 29 performs drive control of the nozzles in units of CMYK nozzle rows of the recording head 28, thereby ejecting ink to the recording medium 12 on the basis of the print data.

In the handheld printer 10, when the communication interface 22 receives a print job (image data) from the smart device 11, the controller 26 calculates the position of each nozzle of the recording head 28 on the basis of input information from the navigation sensors 25. The received image data is stored by the controller 26 in the DRAM 24.

The user holds the handheld printer 10 in his/her hand, and freely moves the handheld printer 10 to scan the recording medium 12. During the scan, the controller 26 continuously calculates position information on each nozzle of the recording head 28. The controller 26 obtains, from the DRAM 24, only an image in a certain area in accordance with the calculated position information. The controller 26 compares the obtained image with the calculated position of each nozzle, and, when the controller 26 determines that the obtained image matches the position of one or more nozzles, sends the print data for that nozzle(s) to the recording head drive circuit 29.

The recording head drive circuit 29 additionally accepts the print timing information, performs drive control of each nozzle of the recording head 28, and causes the recording head 28 to execute printing on the recording medium 12.

Next, an exemplary configuration of the above-described controller 26 will be described with reference to FIG. 3.

Figure 3:
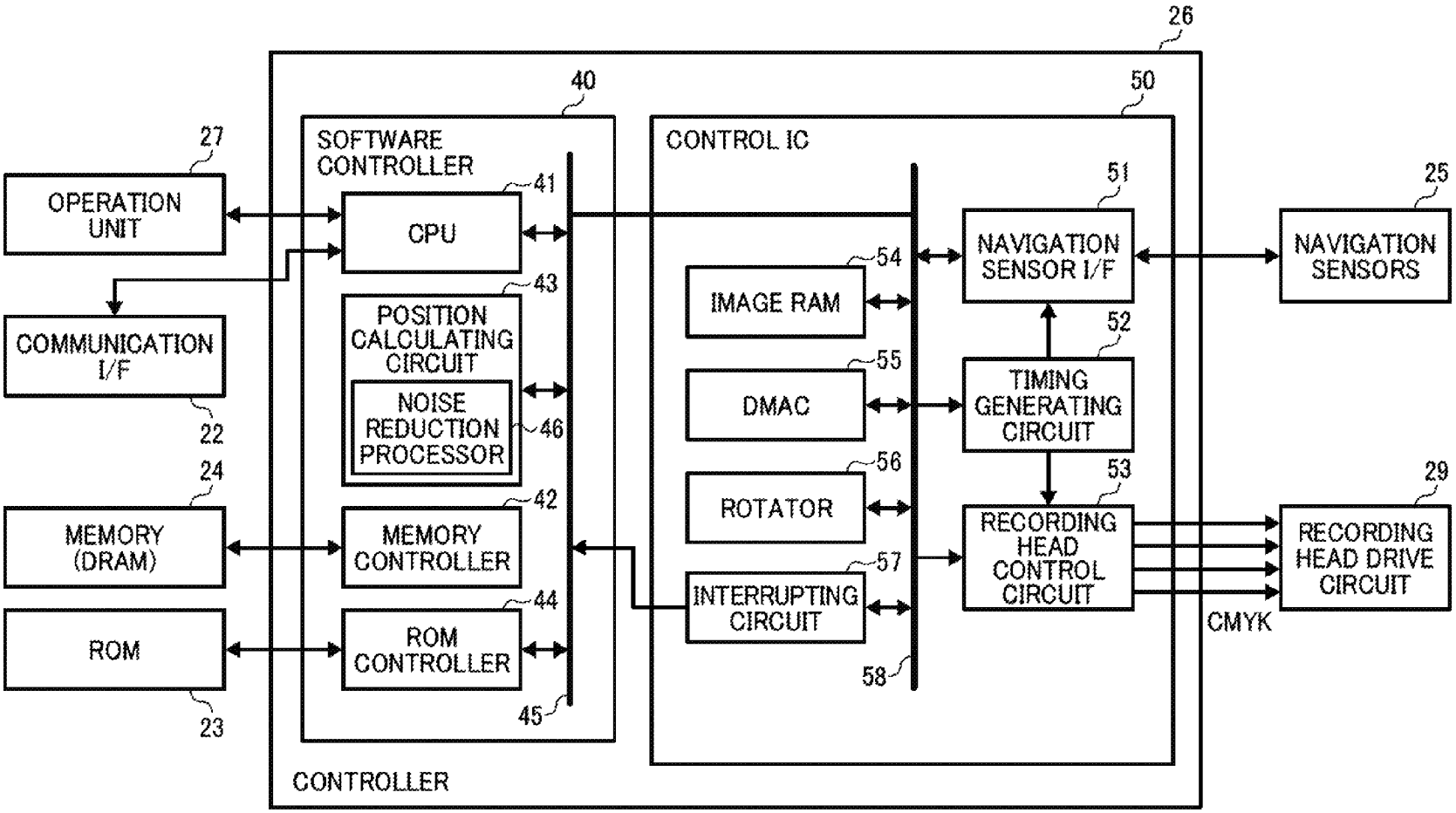
FIG. 3 is a block diagram illustrating an exemplary configuration of a controller illustrated in FIG. 2.

The controller 26 in the embodiment includes a software controller 40 and a control integrated circuit (IC) 50, as illustrated in FIG. 3.

The software controller 40 includes, for example, a system on chip (SoC), and the control IC 50 includes, for example, an application specific integrated circuit (ASIC). Instead of the ASIC, the control IC 50 may include a field programmable gate array (FPGA) whose configuration can be set by the user after the device is manufactured.

The software controller 40 includes a CPU 41, a memory controller 42, a position calculating circuit 43, and a ROM controller 44. These units are connected to a bus 45 and exchange data and the like via the bus 45. The bus 45 is also connected to a bus 58 of the control IC 50, and the units of the software controller 40 can exchange data and the like with the units of the control IC 50.

The CPU 41 is a central processing unit that controls the entire handheld printer 10, and operates in accordance with a program stored in the ROM 23.

The memory controller 42 performs interface control with the DRAM 24, which is a memory. The ROM controller 44 performs interface control with the ROM 23.

The position calculating circuit 43 loads an output value of each of the navigation sensors 25 through the control IC 50, and calculates the position of the recording head 28 and each nozzle and the movement distance under control of the CPU 41.

The position calculating circuit 43 includes a noise reduction processor 46 for implementing noise reduction according to this embodiment of the present invention. The noise reduction processor 46 determines whether noise is included in position coordinate information obtained by the position calculating circuit 43 from the navigation sensors 25. This determination is performed on the basis of output values of two sensors, namely, the navigation sensors 25, and a mounting distance between the two sensors. Position information obtained after the determination is used in calculating corrected position information, thereby reducing the effects of noise and errors.

The determination and calculation operation performed by the noise reduction processor 46 is implemented under control of the CPU 41. In other words, the CPU 41 serves the function of noise reduction and position calculation. The details of this will be described later.

The control IC 50 includes a navigation sensor interface (I/F) 51, a timing generating circuit 52, and a recording head control circuit 53. The control IC 50 further includes an image RAM 54, a direct memory access controller (DMAC) 55, a rotator 56, and an interrupting circuit 57.

These units are connected to the bus 58, and exchange data and the like via the bus 58. The bus 58 is also connected to the bus 45 of the software controller 40, and the units of the control IC 50 can exchange data and the like with the units of the software controller 40.

The navigation sensor I/F 51 communicates with the navigation sensors 25, receives output values (coordinate value changes) of the two sensors, namely, the navigation sensors 25, and stores the values in an internal register, which is an internal memory.

The timing generating circuit 52 generates, with a certain sampling period, a timing signal for causing each of the navigation sensors 25 to emit light and obtaining light reflected from the recording medium 12 as image data, and notifies the navigation sensor I/F 51 of that signal.

That is, the timing generating circuit 52 designates a time point to cause each of the navigation sensors 25 to scan the recording medium 12 and to load output values of the navigation sensors 25.

The timing generating circuit 52 also generates a timing signal for driving the recording head 28, and notifies the recording head control circuit 53 of that signal. That is, the timing generating circuit 52 designates a time point for ejecting ink from each nozzle of the recording head 28 in order to perform printing.

On the basis of the position information calculated by the position calculating circuit 43 of the software controller 40, the DMAC 55 directly controls the memory controller 42 to read from the DRAM 24 image data on an image surrounding each nozzle included in the recording head 28.

The image RAM 54 is a memory that temporarily stores the image data on the surrounding image, read by the DMAC 55. A static RAM (SRAM), for example, is used as the image RAM 54.

The rotator 56 rotates the image data on the surrounding image, read by the DMAC 55, in accordance with the position and tilt of the recording head 28, designated by the user, and outputs the rotated image data to the recording head control circuit 53. The rotator 56 can obtain, for example, a rotation angle calculated at the time the position calculating circuit 43 of the software controller 40 calculates the position coordinates, and, using that rotation angle, can rotate the surrounding image.

The recording head control circuit 53 generates a control signal in accordance with a timing signal for driving the recording head 28, which is sent from the timing generating circuit 52, accepts the image data on the surrounding image, output from the rotator 56, and determines which of the nozzles of the recording head 28 ejects ink. In accordance with the determination result and the timing information, the recording head control circuit 53 outputs, for each of CMYK colors, information on a nozzle(s) that outputs ink, and the print data to the recording head drive circuit 29.

The interrupting circuit 57 has an interrupting signal control function that notifies the software controller 40 of the fact that the navigation sensor I/F 51 ends communication with the navigation sensors 25, at the time the communication is ended. The interrupting circuit 57 additionally has the function of giving a notification of status information, such as an error.

Figure 4:
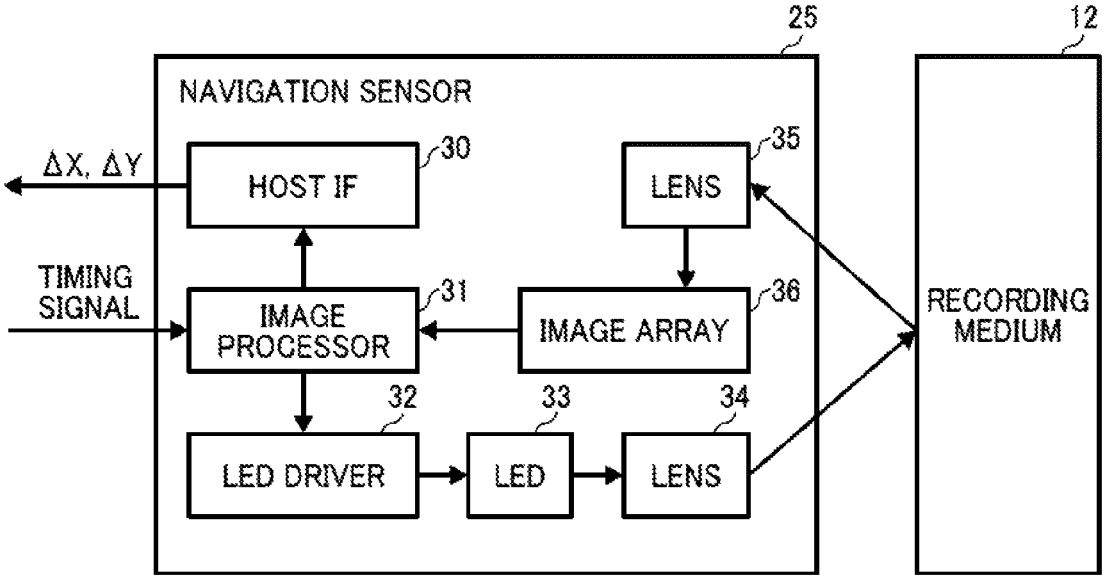
FIG. 4 is a block diagram illustrating an exemplary configuration of each navigation sensor in FIG. 2.

Hereinafter, an exemplary configuration of each of the navigation sensors 25 will be described. FIG. 4 is a block diagram illustrating an exemplary configuration of each navigation sensor 25.

Each navigation sensor 25 includes a host IF 30, an image processor 31, a light-emitting diode (LED) driver 32, an LED 33, two lenses 34 and 35, an image array 36, and an image processor 31. This configuration is the configuration of each of two sensors S0 and S1, namely, the navigation sensors 25, illustrated in FIGS. 6 to 9.

The LED driver 32 causes the LED 33 to emit light, and irradiates the surface of the recording medium 12, such as a sheet of paper, with the light emitted from the LED 33 through the lens 34.

The image array 36 receives light reflected from the recording medium 12 through the lens 35, generates image data from the received light, and outputs the image data to the image processor 31. The lenses 34 and 35 are arranged so as to be optically focused on the surface of the recording medium 12.

On receipt of a reading timing signal from the timing generating circuit 52 illustrated in FIG. 3, the image processor 31 activates the LED driver 32 to cause the LED 33 to emit light. From an image of the image data input from the image array 36, the image processor 31 calculates a movement distance serving as a movement amount of each navigation sensor 25. The movement distance is calculated as a movement distance $\Delta X$ in the X-axis direction and a movement distance $\Delta Y$ in the Y-axis direction. The image processor 31 outputs the calculated movement distance ($\Delta X$, $\Delta Y$) from the host IF 30 to the bus 58 of the control IC 50 illustrated in FIG. 3, and the position calculating circuit 43 of the software controller 40 obtains the output values.

Although an LED is used as the light source in this example, an LED is useful in the case of using a recording medium with a rough surface, such as a sheet of paper. This is because of the following: when the surface is rough, shade is generated, and, it becomes possible to correctly calculate the movement distance in the X-axis and Y-axis directions by using that shade as a characteristic portion.

In contrast, in the case of the recording medium 12 whose surface is smooth or which is transparent, a semiconductor laser (laser diode) that generates a laser light beam can be used as the light source. In doing so, a characteristic portion can be obtained by, for example, forming a striped pattern on the recording medium 12, and the correct movement distance can be calculated on the basis of that characteristic portion.

Next, the function of the navigation sensors 25 will be described with reference to FIG. 5.

Figure 5:
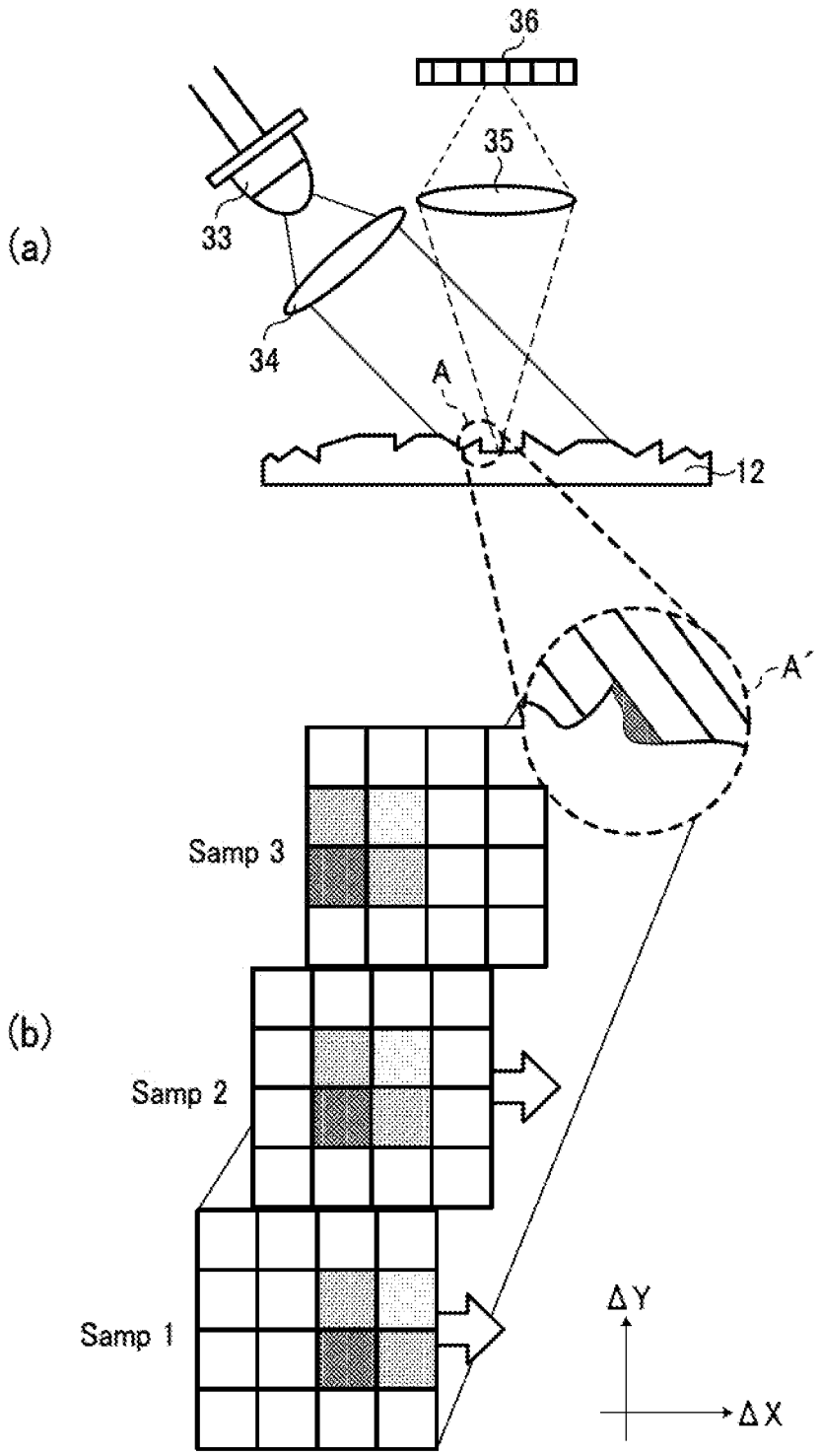
FIG. 5 includes diagrams for describing a function of each navigation sensor in FIG. 2.

As illustrated in FIG. 5(*a*), each navigation sensor 25 irradiates the surface of the recording medium 12 with parallel flux of light, emitted from the LED 33, through the lens 34. Light reflected from the surface of the recording medium 12 is focused by the lens 35 onto a light receiving face of the image array 36.

The recording medium 12 has a rough surface marked by irregularities of various sizes, when viewed in an enlarged format. Therefore, shades of various shapes are generated. A portion indicated by a circle A in FIG. 5(*a*) is enlarged and displayed as a circle A' in FIG. 5(*b*).

The image processor 31 causes the LED driver 32 to cause the LED 33 to emit light, every predetermined sampling period based on a reading timing signal. The image array 36 receives its reflected light, generates image data, and outputs the image data to the image processor 31. On receipt of the image data, the image processor 31 generates a matrix of an image of the image data in defined resolution units. That is, the image processor 31 divides the image into a plurality of rectangular areas.

The image processor 31 compares an image obtained at the previous sampling time point with an image obtained at the current sampling time point, detects a difference between the images, and calculates the difference as a movement distance.

It is assumed that images illustrated in FIG. 5(*b*) are obtained in the order of sampling time points Samp 1, Samp 2, and Samp 3. Referring to FIG. 5(*b*), it is clear in these images that four rectangular areas in a characteristic portion that is a shade represented by black and gray move from right to left by a distance of one resolution at a time.

Therefore, with reference to Samp 1, the four rectangular areas at Samp 2 move only in the X-axis direction by a distance of one resolution. Thus, the output values ($\Delta X$, $\Delta Y$) are (1, 0). Also, with reference to Samp 2, the four rectangular areas at Samp 3 move only in the X-axis direction by a distance of one resolution. Thus, the output values are also (1, 0).

Here, $\Delta X$, $\Delta Y$ are movement distances in the X-axis direction and the Y-axis direction, respectively, with reference to the direction of the sensor, and the sensor outputs these movement distances. Therefore, even when the user rotates the handheld printer 10 in one of the left and right directions on the recording medium 12 and accordingly the navigation sensors 25 rotate, it is impossible to detect that rotation component.

Units of the above-mentioned movement distances depend on the device. In the case of a printer, for example, a resolution of about 1200 dpi is desirable.

Figure 6:
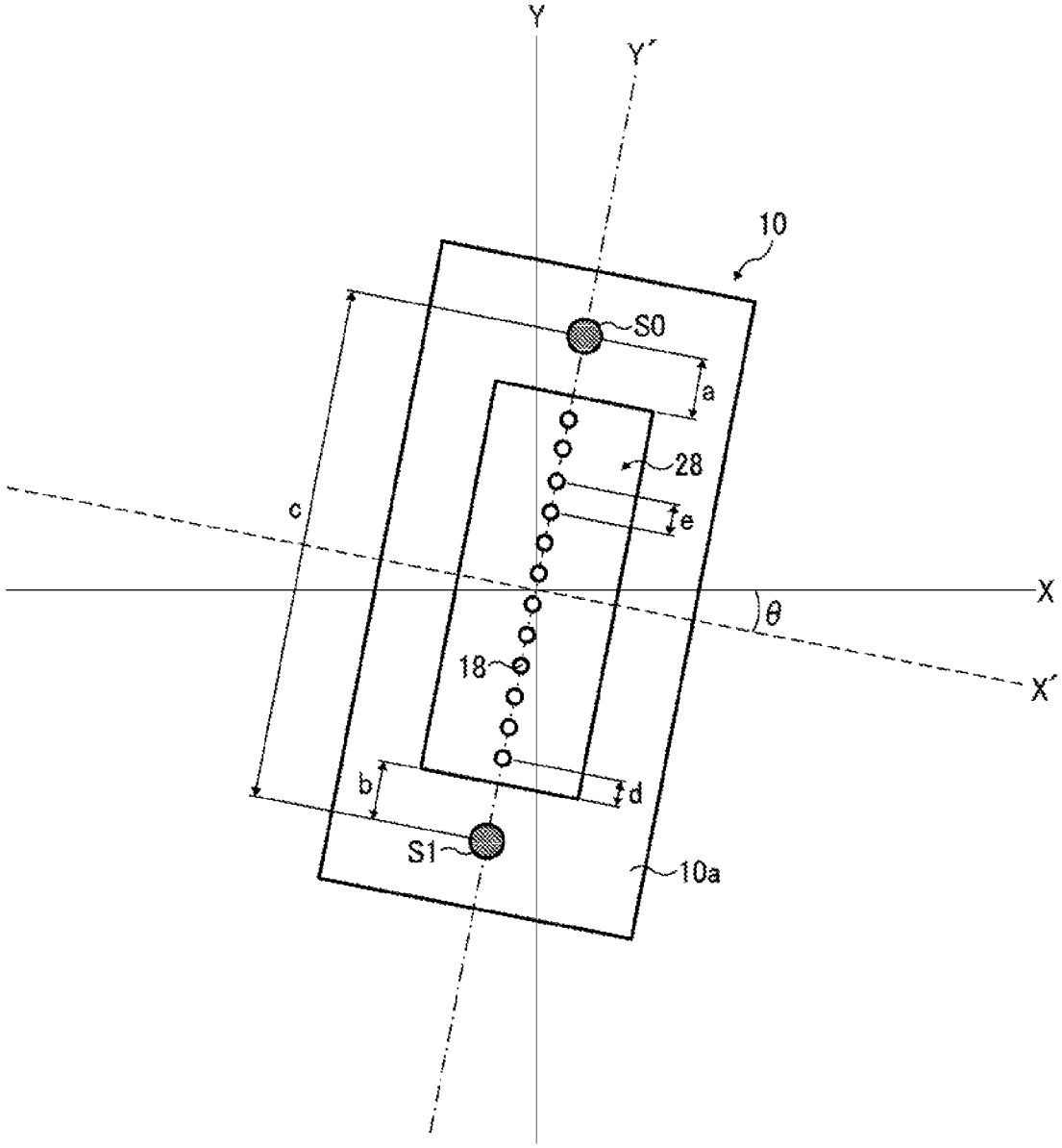
FIG. 6 is a diagram for describing the positional relationship between a recording head and two navigation sensors on a bottom face of the handheld printer illustrated in FIG. 1.

Next, the positional relationship between the navigation sensors and the recording head will be described with reference to FIG. 6. FIG. 6 is a diagram for describing the positional relationship between the recording head and the navigation sensors on a bottom face of the handheld printer 10 illustrated in FIG. 1.

The recording head 28 is arranged inside the periphery of a bottom face 10*a* of the handheld printer 10, along the longitudinal direction. On a lower face of the recording head 28, four nozzle rows, one for each of the CMYK colors, including many nozzles 18 are arranged along the longitudinal direction of the recording head 28. FIG. 6 is simplified to illustrate only one row.

At least two (multiple) navigation sensors 25 are arranged around the recording head 28 on the bottom face 10*a* of the handheld printer 10, at a distance in the direction in which the nozzles 18 are arranged. In the embodiment, a pair of (two) navigation sensors 25 are arranged symmetrically with respect to the center, near two ends in the longitudinal direction of the recording head 28. The paired navigation sensors 25 are referred to as a sensor S0 and a sensor S1, respectively.

A distance from the center of one of the pair, the sensor S0, to one of two ends in the longitudinal direction of the recording head 28 is indicated by a, and a distance from the center of the other sensor, the sensor S1, to the other end in the longitudinal direction of the recording head 28 is indicated by b. The longer the distance c between the centers of the two sensors S0 and S1, the better. This is because, at the time of calculating a position, which will be described later, the longer the distance c (the mounting distance L in FIGS. 7 and 9), the fewer the calculation errors.

Alternatively, three or more navigation sensors may be arranged on one handheld printer. For example, three navigation sensors may be arranged at positions suitable for triangulation. In doing so, the positional relationship among the navigation sensors can be correctly calculated, and it becomes possible to increase the accuracy in calculating position information from the positions of the sensors.

By using sensors other than position sensors, such as acceleration sensors, as navigation sensors, position information can be calculated from multiple types of information.

After the positions of the two sensors S0 and S1 are calculated, the position of each nozzle 18 is calculated using the above-described distances a and b, a distance d from each of two ends in the longitudinal direction of the recording head 28 to a nozzle 18 closest to that end, and a distance e between adjacent nozzles 18.

Since the above-described distances a to e are predetermined distances, the position coordinates of each nozzle 18 of the recording head 28 can be calculated by calculating the position coordinates of the sensors S0 and S1.

It is assumed that the horizontal direction and the vertical direction of the recording medium 12 are the X-axis and the Y-axis, respectively, and the same applies to the output axes of the sensors S0 and S1. As illustrated in FIG. 6, when the handheld printer 10 is tilted by an angle $\theta$ in scanning performed by the user, the output values of the sensors S0 and S1 are not with reference to the X- and Y-axes, but are with reference to the X'- and Y'-axes tilted by the angle $\theta$.

Thus, the output values $\Delta X$ and $\Delta Y$ of the navigation sensors 25 in accordance with the movement of the handheld printer 10 become movement distances moved in the horizontal and vertical directions of the X'- and Y'-axes. Therefore, the output values $\Delta X$ and $\Delta Y$ are not movement distances moved in the horizontal and vertical directions of the X- and Y-axes of the recording medium 12. In such a case, when the coordinate position with respect to the X- and Y-axes of the recording medium 12 is successively calculated from the obtained movement distances, and when the coordinate position is stored, the normal coordinate position can be obtained.

To this end, a position calculating method performed by the navigation sensors will be described with reference to FIG. 7.

Figure 7:
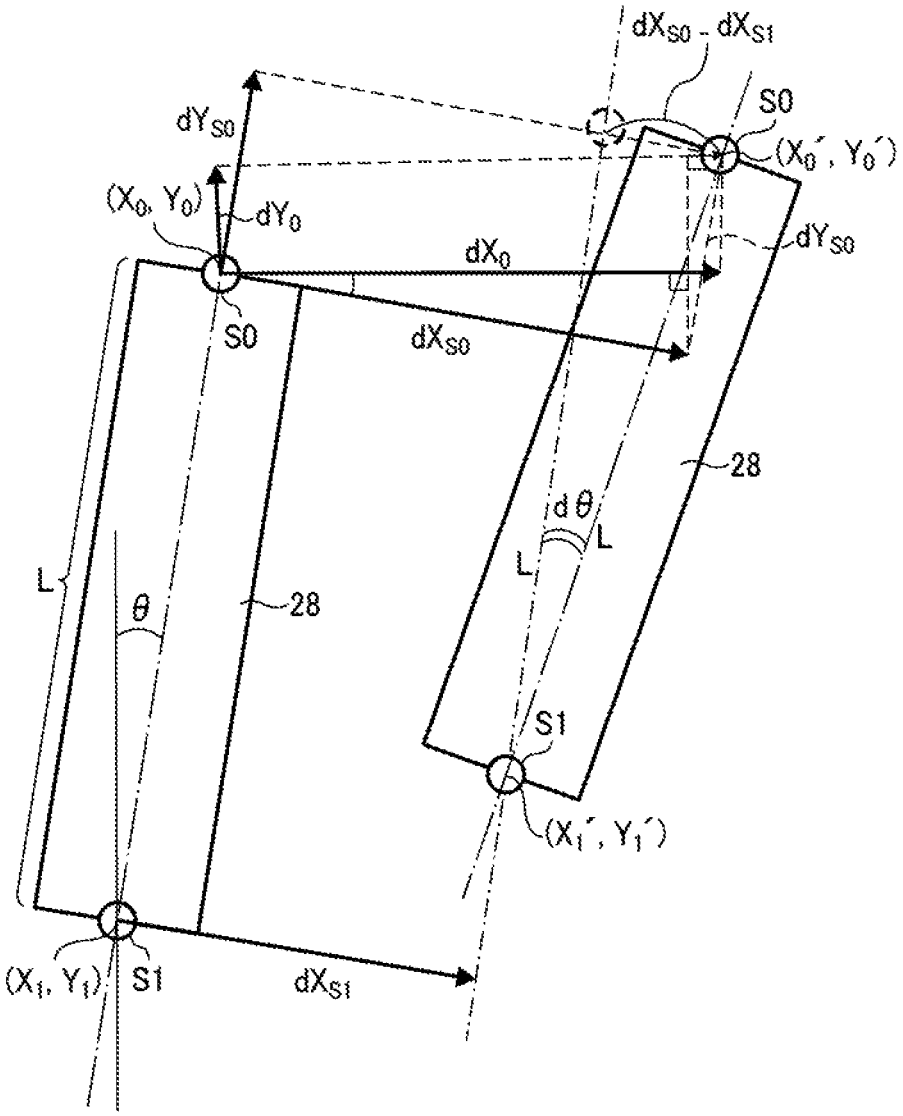
FIG. 7 is a diagram for describing a position calculating method performed by the navigation sensors.

In FIG. 7, the two sensors S0 and S1, which are navigation sensors, are arranged at two ends in the longitudinal direction of the recording head 28. The mounting distance L, which is the physical distance between the two sensors S0 and S1, is known. In this example, the mounting distance L is equal to the length of the recording head 28.

It is assumed that the tilt angle before the movement of the recording head 28 with respect to the coordinate axis of the recording medium (left side in FIG. 7) is θ. It is also assumed that the coordinate position of the center of the sensor S0 before the movement is $(X_0, Y_0)$, and the coordinate position of the center of the sensor S1 before the movement is $(X_1, Y_1)$.

It is assumed that, after the movement of the recording head 28 (right side in FIG. 7), the coordinate position of the center of the sensor S0 becomes $(X_0', Y_0')$, and the coordinate position of the center of the sensor S1 becomes $(X_1', Y_1')$.

The position calculation after the movement is considered in two parts, a rotational component and a parallel component. The rotational component dθ of the recording head 28 is calculated using equation (1) from the difference between the X-direction outputs (movement distances) $dX_{S0}$ and $dX_{S1}$ of the sensor S0 and the sensor S1.

$$d\theta = \tan^{-1}\left(\frac{dX_{s0} - dX_{s1}}{L}\right) \tag{1}$$

The movement amounts $dX_0$ and $dY_0$ of the parallel movement component of the sensor S0 are calculated by holding the tilt angle θ of the recording head 28 and using the following equations of trigonometric functions.

$$dX_0 = dX_{S0} \times \cos\theta + dY_{S0} \times \sin\theta$$

$$dY_0 = -dX_{S0} \times \sin\theta + dY_{S0} \times \cos\theta$$

The position coordinates $(X_0', Y_0')$ after the movement of the sensor S0 are obtained as follows:

$$X_0' = X_0 + dX_0$$

$$Y_0' = Y_0 + dY_0$$

In this case, the position coordinates $(X_1', Y_1')$ of the sensor S1 can be calculated using the following equations from the above-obtained coordinate position of the sensor S0, the tilt angle θ+dθ after the movement of the recording head 28 with respect to the coordinate axis of the recording medium, and the mounting distance L between the sensor S0 and the sensor S1.

$$X_1' = X_0' - L \times \sin(\theta + d\theta)$$

$$Y_1' = Y_0' - L \times \cos(\theta + d\theta)$$

In addition, the addition theorems of trigonometric functions, $$\cos(\alpha+\beta) = \cos\alpha \times \cos\beta - \sin\alpha \times \sin\beta$$

$$\sin(\alpha+\beta) = \sin\alpha \times \cos\beta + \cos\alpha \times \sin\beta$$

and the theorem sin dθ=tan dθ=dθ (when dθ<<1) are used.

This is because dθ becomes a value that is significantly smaller than 1 at the time the actual position of the recording head 28 is calculated by sampling the movement amounts ΔX and ΔY (corresponding to $dX_{S0}$ and $dY_{S0}$) detected by the navigation sensor.

For example, if it is assumed that L=1 inch, scanning is performed at a high speed of 400 mm/s, and the sampling period is 100 μs, the distance moved in one sampling period is 40 μm. Also, the rotatable angles dθ, sin dθ, and tan dθ are dθ=0.0015, sin dθ=0.0015, and tan dθ=0.0015, respectively, thereby deriving dθ<<1.

Since $\sin^2(d\theta)+\cos^2(d\theta)=1$, $\cos(d\theta)=\sqrt{\{1-\sin^2(d\theta)\}}$. From equation (1) described above, $\tan d\theta = (dX_{S0} - dX_{S1})/L = d\theta$ (when dθ<<1).

In this case, calculations for obtaining sin dθ and cos dθ can be omitted, and, using equations (2) and (3) below, sin dθ and cos dθ can be managed from the initial tilt angle θ, and the X-directional movement amounts $dX_{S0}$ and $dX_{S1}$ of the sensor S0 and the sensor S1.

Thus, cos(θ+dθ) can be calculated by equation (2), and sin(θ+dθ) can be calculated by equation (3). Therefore, the position coordinates $(X_1', Y_1')$ after the movement of the sensor S1 can be calculated using the above-mentioned equations for obtaining $X_1'$ and $Y_1'$ from θ, $dX_{S0}$, $dX_{S1}$, and the mounting distance L between the sensors S0 and S1, which is a fixed value.

$$\begin{aligned}\cos(\theta + d\theta) &= \cos\theta \times \cos(d\theta) - \sin\theta \times \sin(d\theta) \\ &= \cos\theta \times \sqrt{1 - \sin^2(d\theta)} - \sin\theta \times \sin(d\theta) \because -90° < d\theta < 90° \\ &= \cos\theta \times \sqrt{1 - (d\theta)^2} - \sin\theta \times d\theta \because d\theta \ll 1 \\ &= \cos\theta \times \sqrt{1 - \left(\frac{dX_{s0} - dX_{s1}}{L}\right)^2} - \sin\theta \times \frac{dX_{s0} - dX_{s1}}{L}\end{aligned} \tag{2}$$

$$\begin{aligned}\sin(\theta + d\theta) &= \sin\theta \times \cos(d\theta) + \cos\theta \times \sin(d\theta) \\ &= \sin\theta \times \sqrt{1 - \sin^2(d\theta)} + \cos\theta \times \sin(d\theta) \because -90° < d\theta < 90° \\ &= \sin\theta \times \sqrt{1 - (d\theta)^2} + \cos\theta \times d\theta \because d\theta \ll 1 \\ &= \sin\theta \times \sqrt{1 - \left(\frac{dX_{s0} - dX_{s1}}{L}\right)^2} + \cos\theta \times \frac{dX_{s0} - dX_{s1}}{L}\end{aligned} \tag{3}$$

When the position calculating circuit 43 illustrated in FIG. 3 continuously performs the above-described calculations at a reading time point every sampling period, the two-dimensional coordinate positions of the sensors S0 and S1, which are a pair of navigation sensors, with respect to the recording medium can be successively obtained.

Now, the actual movement of the handheld printer and position information on the navigation sensors will be described with reference to FIGS. 8A to 8C.

Figure 8A:
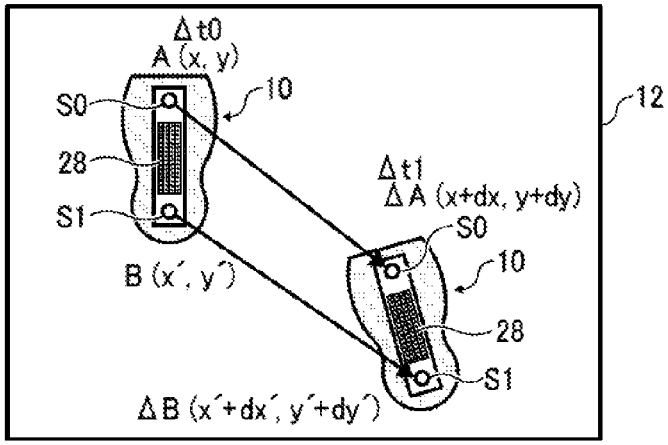
FIGS. 8A to 8C (FIG. 8) are diagrams for describing the actual movement of the handheld printer and position information on the navigation sensors.
Figure 8B:
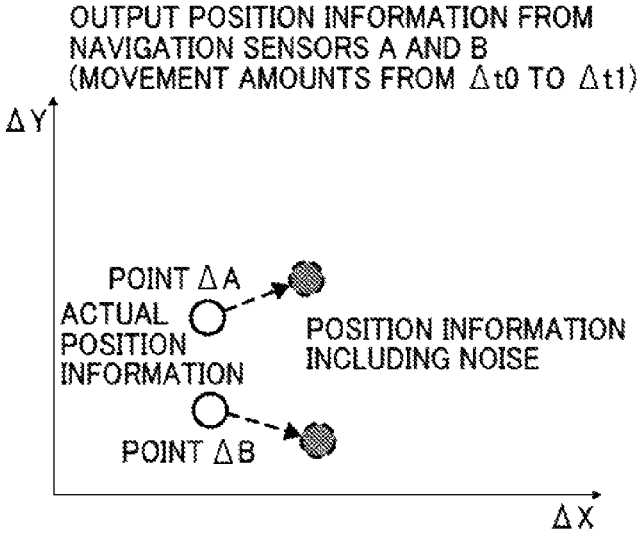
Figure 8C:
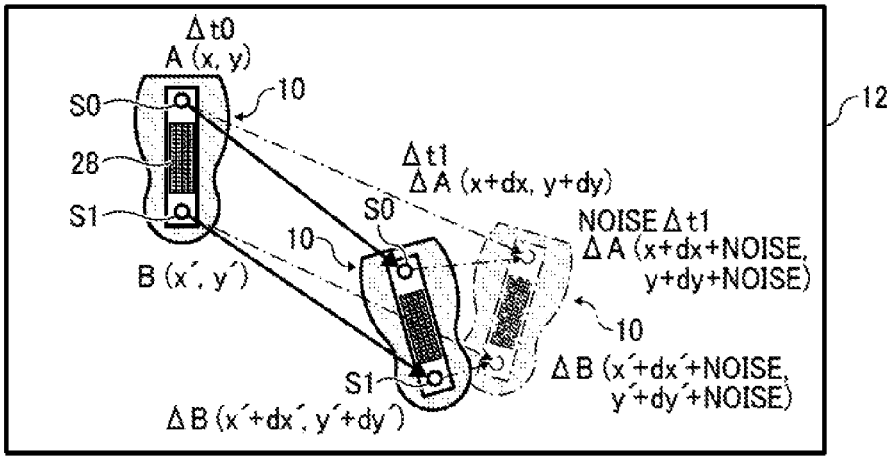

In FIGS. 8A to 8C, the handheld printer 10 includes the recording head 28, and the two sensors S0 and S1, which are navigation sensors, at two ends in the longitudinal direction of the recording head 28. Actually, the recording head 28 side of the handheld printer 10 is pressed against the recording medium 12 and the handheld printer 10 is moved with a hand to perform printing. For the convenience of the description, the recording head 28 side is illustrated as an upper face.

FIG. 8A illustrates the trajectory of the actual movement of the handheld printer.

Point A and point B indicate positions of the sensor S0 and the sensor S1, respectively, before the movement (at time point Δt0). It is assumed that position information at point A is A(x, y), and position information at point B is B(x', y').

Point ΔA and point ΔB indicate the positions of the sensor S0 and the sensor S1, respectively, at time point Δt1 after the movement. At that time point, the movement amount of the sensor S0 is (dx, dy), and the position information at point ΔA is Δ(x+dx, y+dy). The movement amount of the sensor S1 is (dx', dy'), and the position information at point ΔB is ΔB(x'+dx', y'+dy').

FIG. 8B illustrates an example in the case where the position information on the sensors S0 and S1 after the movement includes noise.

In the case where the position information on the sensors S0 and S1 after the movement (at time point Δt1) includes no noise, the positions at point ΔA and point ΔB are indicated by white circles. In contrast, in the case where the position information includes noise, the positions at point ΔA and point ΔB are detected as, for example, positions indicated by black circles.

With respect to the movement amounts from point A and point B to point ΔA and ΔB at time point Δt1 after the movement, when the output values of the sensors S0 and S1 include noise, the actual position information on the sensors S0 and S1 is different from the position information calculated on the basis of the output values of the sensors S0 and S1. The noise in this case is electrically at random and is generated at random.

FIG. 8C is a schematic diagram illustrating a positional deviation between the actual position of the handheld printer 10 after the movement and the position of the handheld printer 10 calculated on the basis of the sensor output values including noise.

In the case where the output values of the sensors S0 and S1 include noise at time point NoiseΔt1, position information calculated on the basis of the output value of the sensor S0 becomes ΔA(x+dx+Noise, y+dy+Noise), and position information calculated on the basis of the output value of the sensor S1 is ΔB(x'+dx'+Noise, y'+dy'+Noise).

In this manner, in the case where the output values of the sensors S0 and S1 include noise, the actual position of the handheld printer 10 after the movement is deviated from the position of the handheld printer 10 calculated on the basis of the output values of the sensors S0 and S1. Therefore, if the output values of the sensors S0 and S1 include noise, the position of the handheld printer 10, that is, the accurate position information on the recording head 28, cannot be obtained.

To this end, a noise determination method and a correction method used in the embodiment of the present invention will be described using FIGS. 9 to 16.

Figure 9B:
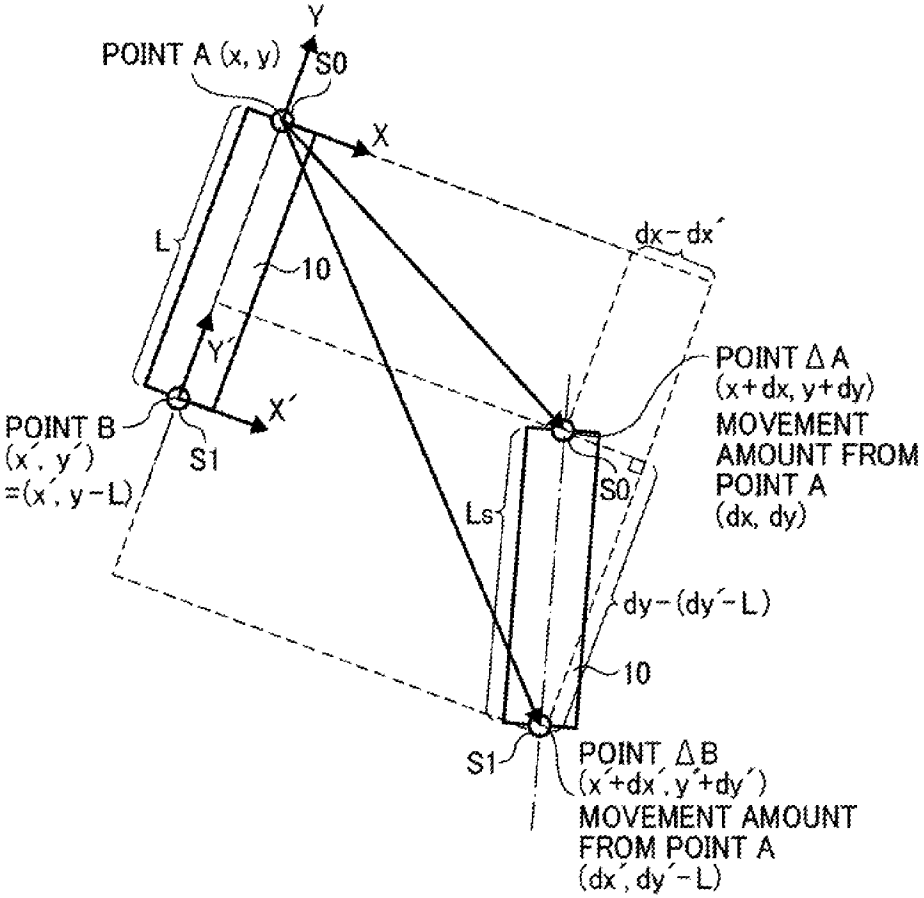
FIGS. 9A and 9B (FIG. 9) are diagrams for describing noise determination using sensor output values of the navigation sensors and a sensor-to-sensor distance.
Figure 9A:
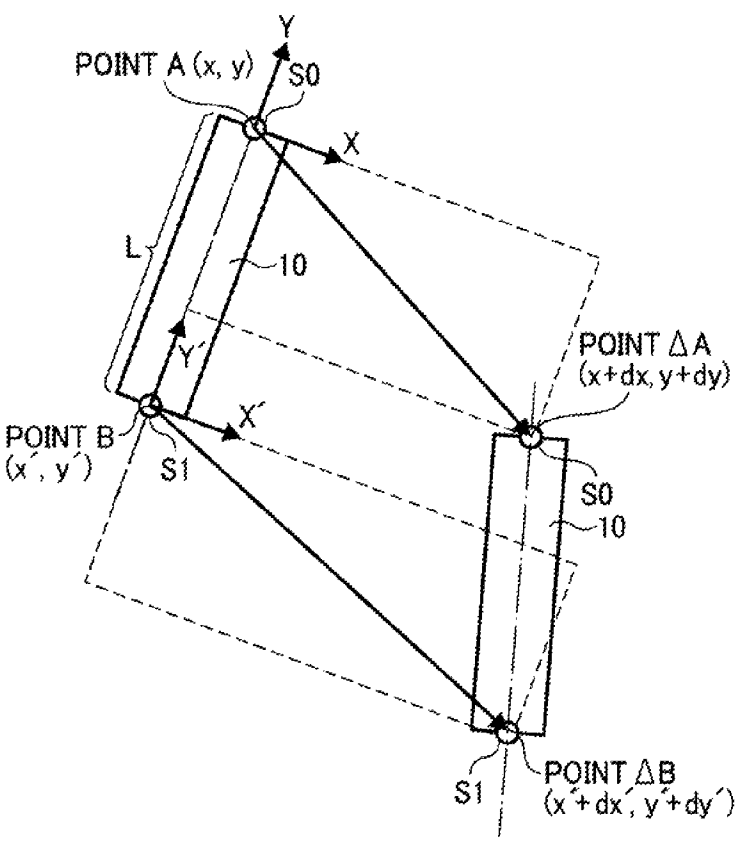

FIGS. 9A and 9B are diagrams for describing noise determination using sensor output values of the navigation sensors and a sensor-to-sensor distance.

FIG. 9A illustrates, in the case where the handheld printer 10 is moved, the trajectory of the moved handheld printer 10 on the basis of the output values of the two sensors S0 and S1, which are navigation sensors.

Point A and point B indicate positions of the sensor S0 and the sensor S1, respectively, before the movement. It is assumed that position information at point A is A(x, y), and position information at point B is B(x', y').

Point ΔA and point ΔB indicate positions of the sensor S0 and the sensor S1, respectively, after the movement. The movement amount in the X-axis and Y-axis directions of the sensor S0 is (dx, dy), and the position information at point ΔA is ΔA(x+dx, y+dy). The movement amount in the X-axis and Y-axis directions of the sensor S1 is (dx', dy'), and the position information at point ΔB is ΔB(x'+dx', y'+dy'). L indicates the mounting distance between the two sensors S0 and S1, which is a known fixed value.

Regarding the navigation sensors after the movement, the sensor S0 outputs the amount of movement (dx, dy) from point A, which is a reference point, in accordance with the X-Y plane of the sensor S0, every sampling period. The sensor S1 outputs the amount of movement (dx', dy') from point B, which is a reference point, in accordance with the X-Y plane of the sensor S1, every sampling period.

FIG. 9B indicates conversion of the movement amounts (dx, dy) and (dx', dy') in accordance with the X-Y plane of the sensors S0 and S1, respectively, to relative movement amounts from point A, using the mounting distance L between the two sensors S0 and S1.

With the mounting distance L between the two sensors S0 and S1, the amounts of change in accordance with the X-Y plane of the sensors S0 and S1, respectively, can be converted to position information from the same reference point. A change in the X-axis direction at point ΔB that is in accordance with the X-Y plane at point A is the same as the amount of change in the X-axis direction with reference to point A. A change in the Y-axis direction at point ΔB can be represented as the value dy'−L, which is a value obtained by subtracting the sensor-to-sensor mounting distance L, which is from the Y-axis with reference to point A, from the change amount dy' of the sensor S1.

Using the amounts of change at point ΔA and point ΔB from point A, the distance between the two points, point ΔA and point ΔB, that is, the distance Ls between the two navigation sensors, is calculated using equation (4).

$$Ls=\sqrt{(dx-dx')^2+(dy-(dy'-L))^2} \tag{4}$$

During scanning performed by the handheld printer 10, the timing generating circuit 52 in the control IC 50 illustrated in FIG. 3 generates a timing signal with a certain sampling period.

Whenever the timing signal is generated, the controller 26 including the noise reduction processor 46 reads and samples the output values of the two sensors S0 and S1, which are the navigation sensors 25.

The noise reduction processor 46 determines whether the output values dx, dy, and dx', dy' include noise, on the basis of these output values, and the known mounting distance L between the two sensors S0 and S1. In the case where it is determined that one of the output values includes noise, the noise reduction processor 46 corrects or rejects that output value to remove noise.

In doing so, even when the position information, which is an output value from one of the navigation sensors, includes noise, the correct position information can be obtained.

In that case, the presence of noise can be determined as follows in accordance with the difference |L−Ls| (absolute value) between the distance Ls calculated by equation (4) described above, and the mounting distance L between the two sensors S0 and S1.

In the case of |L−Ls|≤ the noise tolerance (the difference is less than or equal to the noise tolerance), it is determined that the movement amounts at point ΔA and point ΔB, which are the output values of the sensors S0 and S1, include no noise.

In the case where |L−Ls|> the noise tolerance (the difference exceeds the noise tolerance), it is determined that one of the movement amounts at point ΔA and point ΔB, which are the output values of the sensors S0 and S1, includes noise.

In doing so, the sensor output value(s) at a sampling time point including noise can be determined.

Figure 10:
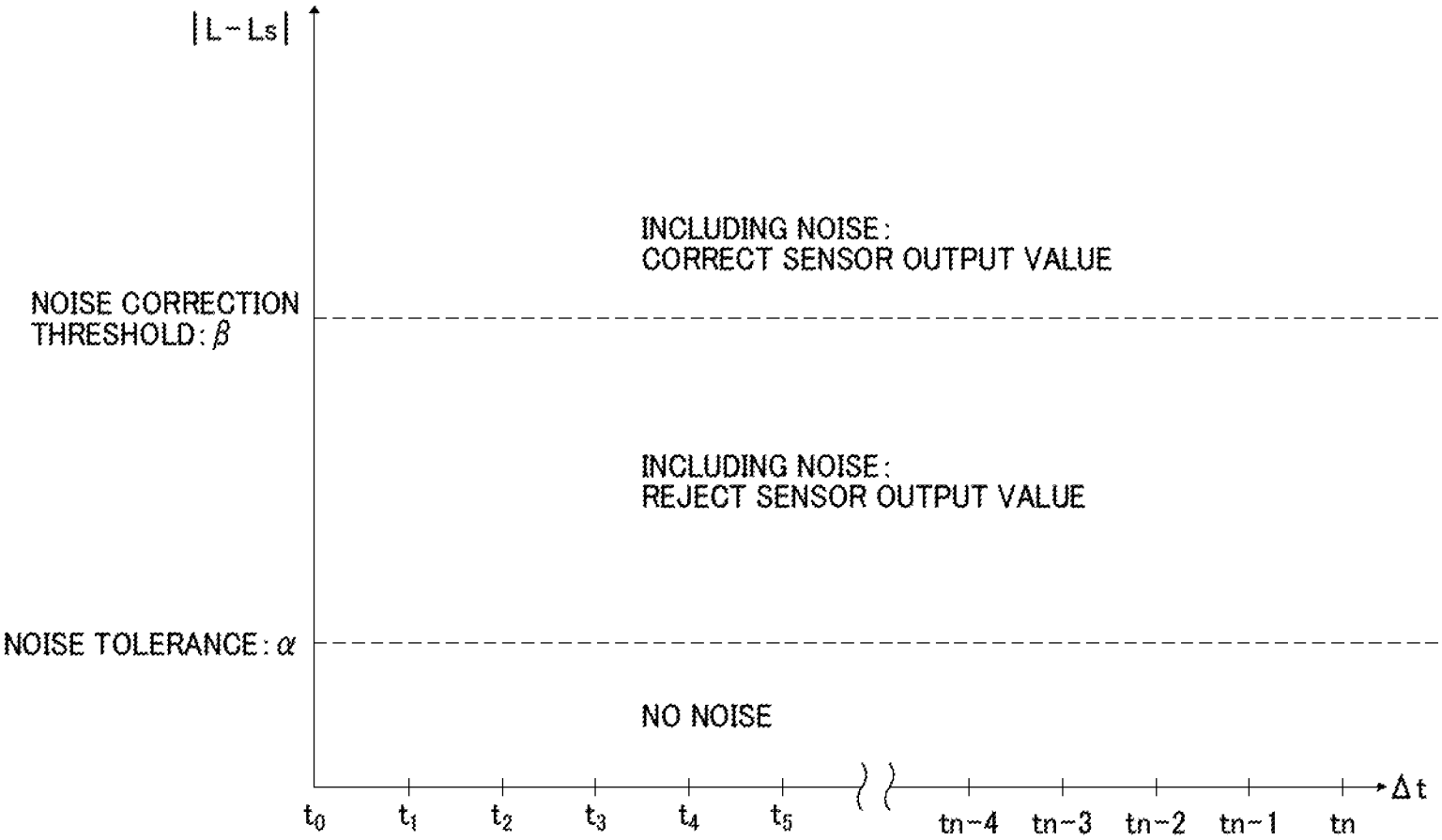
FIG. 10 is a diagram for describing identification of the sensor output values using a difference $|L-Ls|$ between a calculated distance Ls and a mounting distance L.

FIG. 10 is a diagram for describing identification of the sensor output values using the difference |L−Ls| between the calculated distance Ls and the mounting distance L.

Referring to FIG. 10, identification of the sensor output values using the difference (absolute value) between the calculated sensor-to-sensor distance Ls based on the output values of the two sensors S0 and S1 illustrated in FIG. 9 and the mounting distance L between the sensors S0 and S1 will be described.

A noise tolerance α of |L−Ls| illustrated in FIG. 10 is set in advance in a memory in the controller 26 illustrated in FIGS. 2 and 3. This noise tolerance α is changeable in accordance with the accuracy of printing or the movement speed. The user can also select or change the noise tolerance α by using the operation unit 27.

In the case where |L−Ls| is less than or equal to the noise tolerance α (|L−Ls|≤α), the CPU 41 illustrated in FIG. 3 determines that the output values of the sensors S0 and S1, which are the navigation sensors 25, include no noise.

In the case where |L−Ls| exceeds the noise tolerance α (|L−Ls|>α), the CPU 41 determines that at least one of the output values of the sensors S0 and S1 includes noise.

The same applies to the following case in which some changes are made: In the case of |L−Ls|<α (less than α), it is determined that the output values of the sensors S0 and S1 include no noise; and, in the case of |L−Ls|≥α (greater than or equal to α), it is determined that at least one of the output values of the sensors S0 and S1 includes noise.

In this example, further a noise correction threshold β is employed to determine whether to correct the sensor output values (dx, dy) and (dx', dy') of the sensors S0 and S1 at the same sampling time point, or to ignore and reject the sensor output values. The noise correction threshold β is greater than the noise tolerance α (β>α).

In the case where |L−Ls| exceeds the noise tolerance α, and further |L−Ls| exceeds the noise correction threshold β (|L−Ls|>β), it is indicated that the difference between the sensor-to-sensor distance Ls calculated from the output values of the sensors S0 and S1 and the sensor-to-sensor mounting distance L is significantly great. That is, the output values of the sensors S0 and S1 greatly differ from the actual movement amount of the handheld printer 10. Thus, the error between the output values of the sensors S0 and S1 and the actual movement amount is minimized by correcting the output values.

In addition, even when |L−Ls| exceeds the noise tolerance α, if |L−Ls| is less than or equal to the noise correction threshold β (α<|L−Ls|≤β), it is difficult to determine whether the output value(s) should be corrected. Thus, it takes time to perform calculation for identifying the sensor output value that includes noise, and the load on the software controller 40 illustrated in FIG. 3 is increased. In such a case, no correction is performed, and the sensor output values at that time are both rejected and are not used for position calculation.

In doing so, determination of whether to correct an output value that includes noise can be facilitated.

The noise correction threshold β is set in advance in a memory in the controller 26. The user may be allowed to select or change the noise correction threshold β by using the operation unit 27.

The same applies to the following case in which some changes are made: The case in which |L−Ls|>β is changed to the case in which |L−Ls|≥β (greater than or equal to β), and the case in which |L−Ls|≤β is changed to the case in which |L−Ls|<β (less than β).

Figure 11:
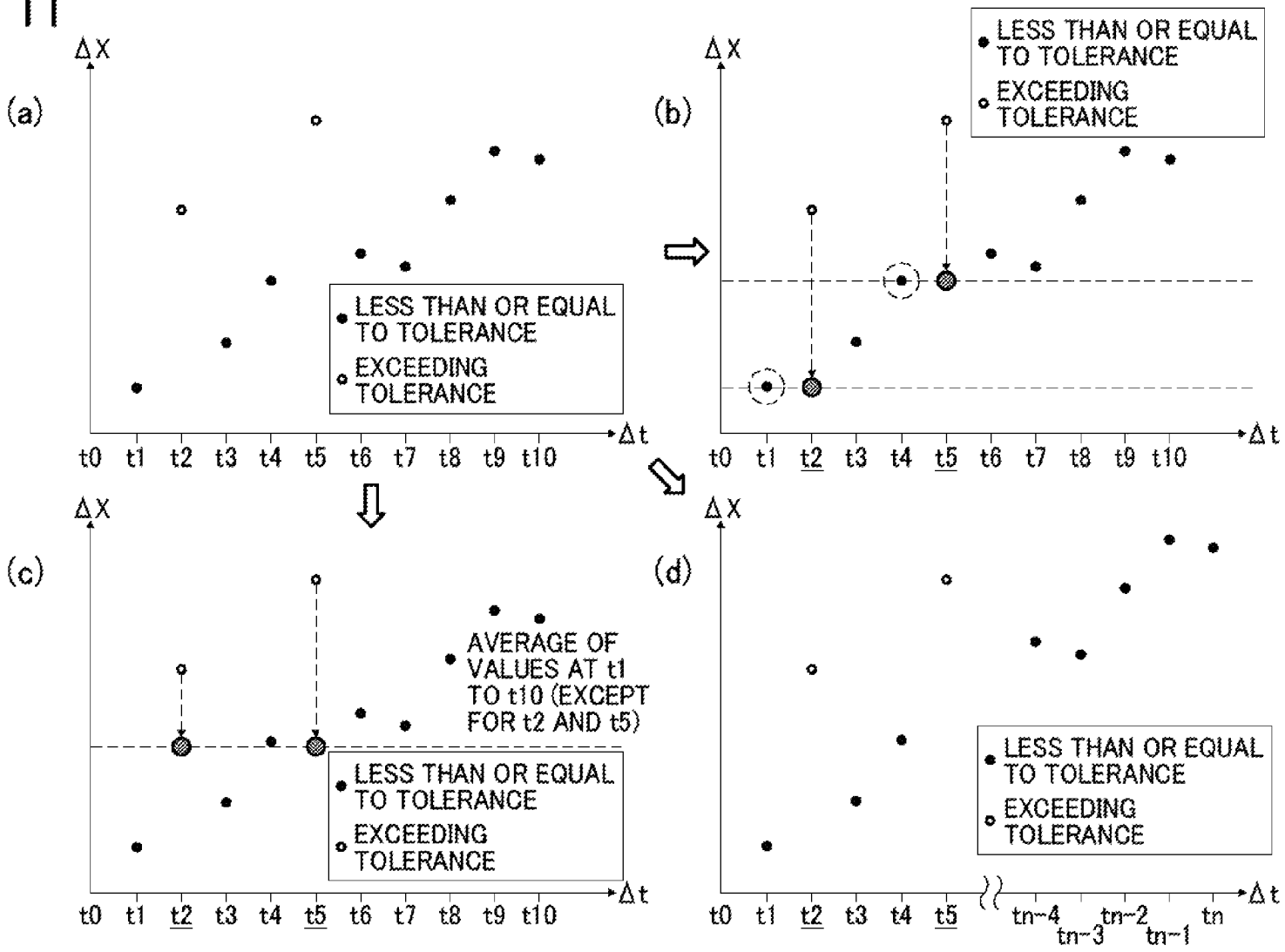
FIG. 11 includes diagrams for describing a threshold for determining the presence of noise by calculating an average of sensor output values in the case where $|L-Ls|$ exceeds a noise tolerance.

FIG. 11 includes diagrams for describing a method of correcting one of the sensor output values of the navigation sensors.

Part (a) of FIG. 11 is a schematic diagram for describing the movement amount in the X-axis direction of one sensor, such as the sensor S0, out of the two sensors S0 and S1, at reading time points t1 to t10 every certain sampling period.

In this case, the sensor output value (dx, dy) described in FIG. 9 matches the movement amount on the X-Y plane of the handheld printer 10. In addition, the presence of noise is determined by using the difference |L−Ls| between the sensor-to-sensor distance Ls, calculated on the basis of the output values from the two sensors S0 and S1 illustrated in FIG. 9, and the mounting distance L between the sensors S0 and S1.

Referring to FIG. 11, a black circle indicates a sensor output value in the case where |L−Ls| is less than or equal to the noise tolerance illustrated in FIG. 10, that is, a sensor output value determined not to include noise. In addition, a white circle indicates a sensor output value in the case where |L−Ls| exceeds the noise tolerance, that is, a sensor output value determined to include noise.

Referring to parts (b) to (d) of FIG. 11, a method of correcting a sensor output value in the case where |L−Ls| exceeds the noise tolerance will be described.

As has been described with reference to FIG. 10, when |L−Ls| exceeds the noise tolerance, it may be unclear which of the output values (dx, dy) and (dx', dy') of the two sensors S0 and S1 includes noise. Since it takes time to perform calculation for identifying the output value that includes noise, it may be desirable to alleviate the load on the software controller 40. In such cases, no noise correction may be performed on the sensor output values, and both of the sensor output values of the two sensors S0 and S1 at the same sampling time point may be rejected and may not be used for position calculation.

In doing so, while the load on the software controller 40 is alleviated, effects of the noise are minimized, thereby minimizing an error in the position information.

Alternatively, in such cases, both of (all) the output values of the two sensors S0 and S1 at the same sampling time point may be corrected. In doing so, while the load on the software controller 40 is alleviated, effects of the noise are minimized, thereby further minimizing an error in the position information. The correction can be performed as follows, for example.

In the example illustrated in part (b) of FIG. 11, a sensor output value (indicated by a white circle) in the case where |L−Ls| exceeds the noise tolerance is corrected by replacing that sensor output value (indicated by a white circle) with a sensor output value (indicated by a black circle encircled by a circle of a broken line) at one previous sampling time point in which |L−Ls| is less than or equal to the noise tolerance. When a sensor output value at one previous sampling time point is not a sensor output value (indicated by a black circle) in which |L−Ls| is less than or equal to the noise tolerance, the sensor output value (indicated by a white circle) is replaced with a sensor output value (indicated by a black circle) at yet previous sampling time point in which |L−Ls| is less than or equal to the noise tolerance.

In other words, an output value determined by the noise reduction processor 46 illustrated in FIG. 3 to include noise is replaced with an immediately-preceding corresponding output value obtained by prior sampling and determined not to include noise.

Accordingly, an output value determined to include noise can be relatively easily corrected.

In the example illustrated in part (c) of FIG. 11, when |L−Ls| exceeds the noise tolerance, in sampling performed a certain number of times (t1 to t10), an average (indicated by a broken line) of sensor output values (indicated by a black circle) in the case where |L−Ls| is less than or equal to the noise tolerance is calculated. A sensor output value (indicated by a white circle) in the case where |L−Ls| exceeds the noise tolerance is corrected by replacing that sensor output value (indicated by a white circle) with the average.

In other words, an output value determined by the noise reduction processor 46 illustrated in FIG. 3 to include noise is replaced with an average of corresponding output values obtained by sampling performed a certain number of times and determined not to include noise. Accordingly, the correction accuracy can be improved.

Part (d) of FIG. 11 indicates that the number of times sensor-output-value sampling is performed to calculate the position of the handheld printer 10 is not a certain number, but is a variable number (n times).

In addition, the sampling period can be made variable, and accordingly, the number of samples can also be made variable in a certain period of time. Therefore, the number of samples necessary for noise reduction can be secured, and the accuracy of position information can be maintained.

The sampling period may be changeable in accordance with the recording (printing) mode or the characteristics of the device. In doing so, the sampling period suitable for the recording accuracy or the sensor characteristics can be used.

The position calculating circuit 43 of the software controller 40 illustrated in FIG. 3 calculates the position of the handheld printer 10 from the sensor output values of the navigation sensors 25 every sampling period. In that case, the sampling period and the number of times sampling is performed in which the software controller 40 reads the output values of the sensors S0 and S1, which are the navigation sensors 25, are changed as described above, thereby obtaining appropriate sensor output values.

For example, the sampling period and the number of times sampling is performed are changed in accordance with the requested accuracy of printing (such as 600 dpi or 1200 dpi) in accordance with the printing mode, or the movement speed of the handheld printer 10. Since the navigation sensors' image resolution and processing speed are different according to the performance of the navigation sensors, the sampling period and the number of times sampling is performed can also be changed in accordance with the characteristics of the device being used.

Figure 12:
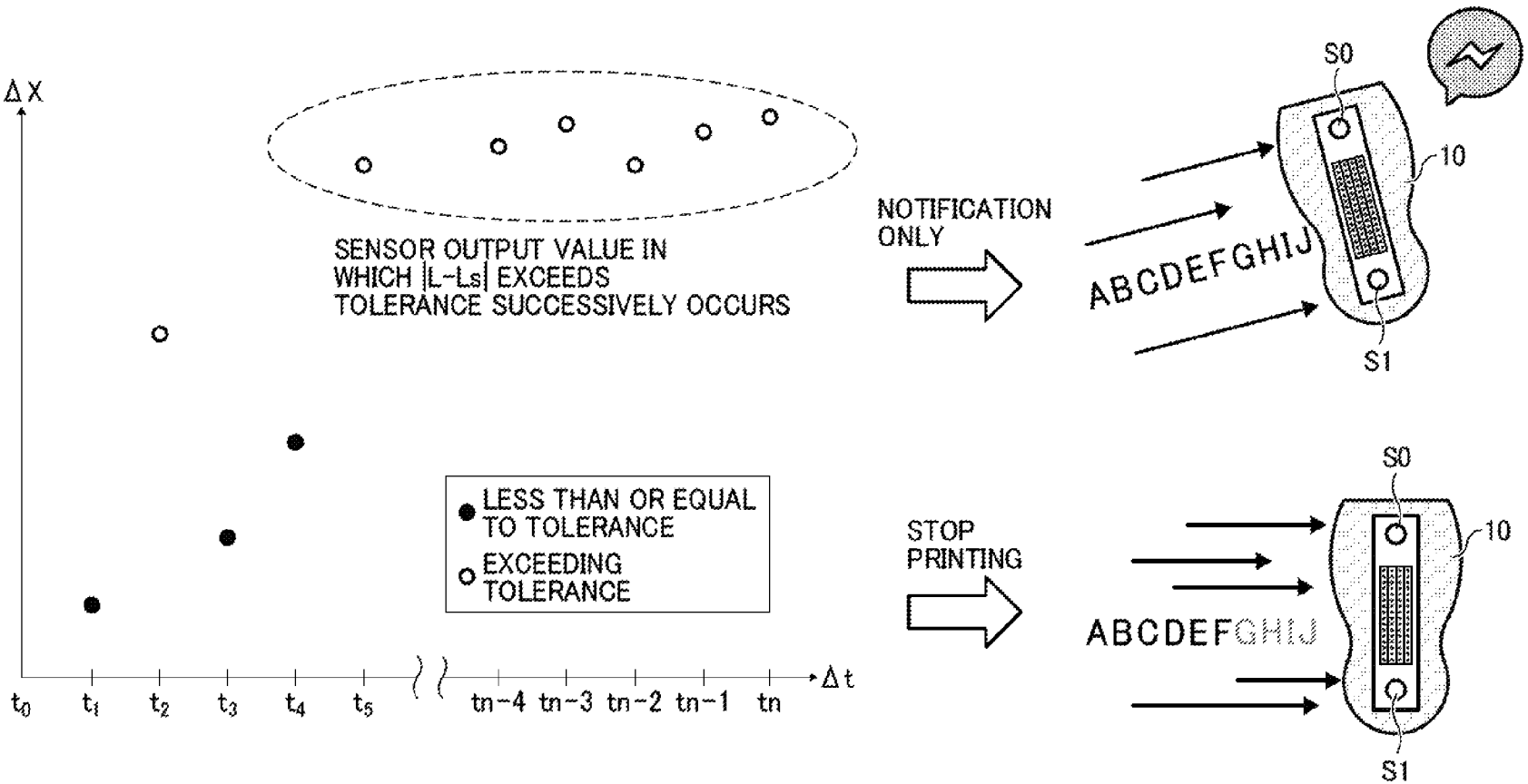
FIG. 12 is a diagram for describing how to handle the handheld printer in the case of successive sensor output values in which $|L-Ls|$ exceeds the noise tolerance.

FIG. 12 is a diagram for describing how to handle the handheld printer in the case of successive sensor output values in the case where |L−Ls| exceeds the noise tolerance.

Every sampling period, the software controller 40 illustrated in FIG. 3 reads output values from the sensors S0 and S1, which are the navigation sensors 25. As a result, as indicated by an ellipse of a broken line in FIG. 12, the above-described |L−Ls| may exceed the noise tolerance for some reason, and an output value determined to include noise may successively occur for a certain number of times or greater.

In such a case, the controller 26 illustrated in FIG. 3 has the function of notifying the user of an emergency (abnormality) by displaying that on the display of the operation unit 27 or turning on the LED. In such a case, it is preferable that the controller 26 have the function of stopping printing (recording operation) of the handheld printer 10, as well as notifying the user of an emergency. The user may be allowed to select or change this function by using the operation unit 27. Accordingly, the usability is improved.

Figure 13B:
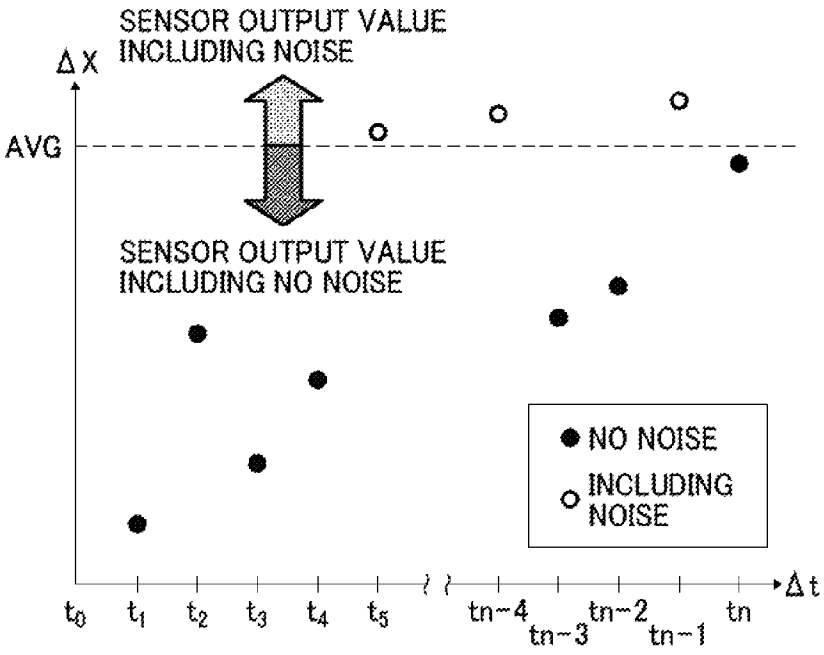
FIGS. 13A and 13B (FIG. 13) are diagrams for describing a threshold for determining the presence of noise by calculating an average of sensor output values in the case where the difference $|L-Ls|$ exceeds the noise tolerance.
Figure 13A:
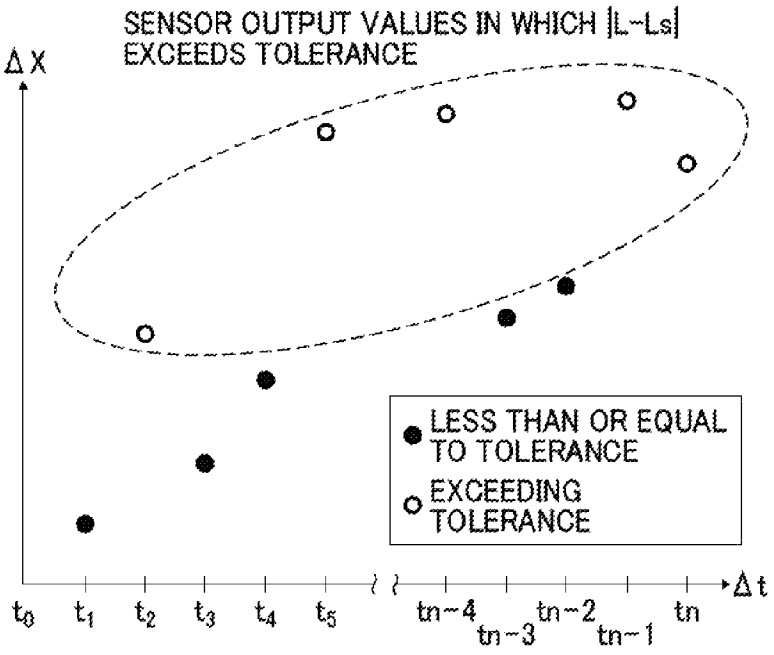

FIGS. 13A and 13B (FIG. 13) are diagrams for describing a threshold for determining the presence of noise by calculating an average of sensor output values in the case where the difference |L−Ls| exceeds the noise tolerance.

Referring to FIG. 13, in the case where the above-described |L−Ls| exceeds the noise tolerance, an exemplary method of determining which of the output values (dx, dy) and (dx', dy') of the two sensors S0 and S1 at the same sampling time point includes noise will be described.

To this end, in sampling performed a certain number of times, an average of output values (indicated by a white circle) corresponding to an ellipse of a broken line in FIG. 13A, in the case where |L−Ls| exceeds the noise tolerance, is calculated and regarded as a threshold.

It is determined that a sensor output value (indicated by a white circle) exceeding the average indicated by a broken line in FIG. 13B includes noise, and a sensor output value less than or equal to the average includes no noise.

By performing this determination for each of the output values (dx, dy) and (dx', dy') of the sensors in the case where |L−Ls| exceeds the noise tolerance, it is possible to determine which of the output values in which direction of which sensor includes noise.

Accordingly, an output value including noise can be identified, only that output value can be corrected, and the other output value can be adopted as it is. It is possible to minimize an error between the actual movement amount of the handheld printer 10 and the sensor output values.

Figure 14:
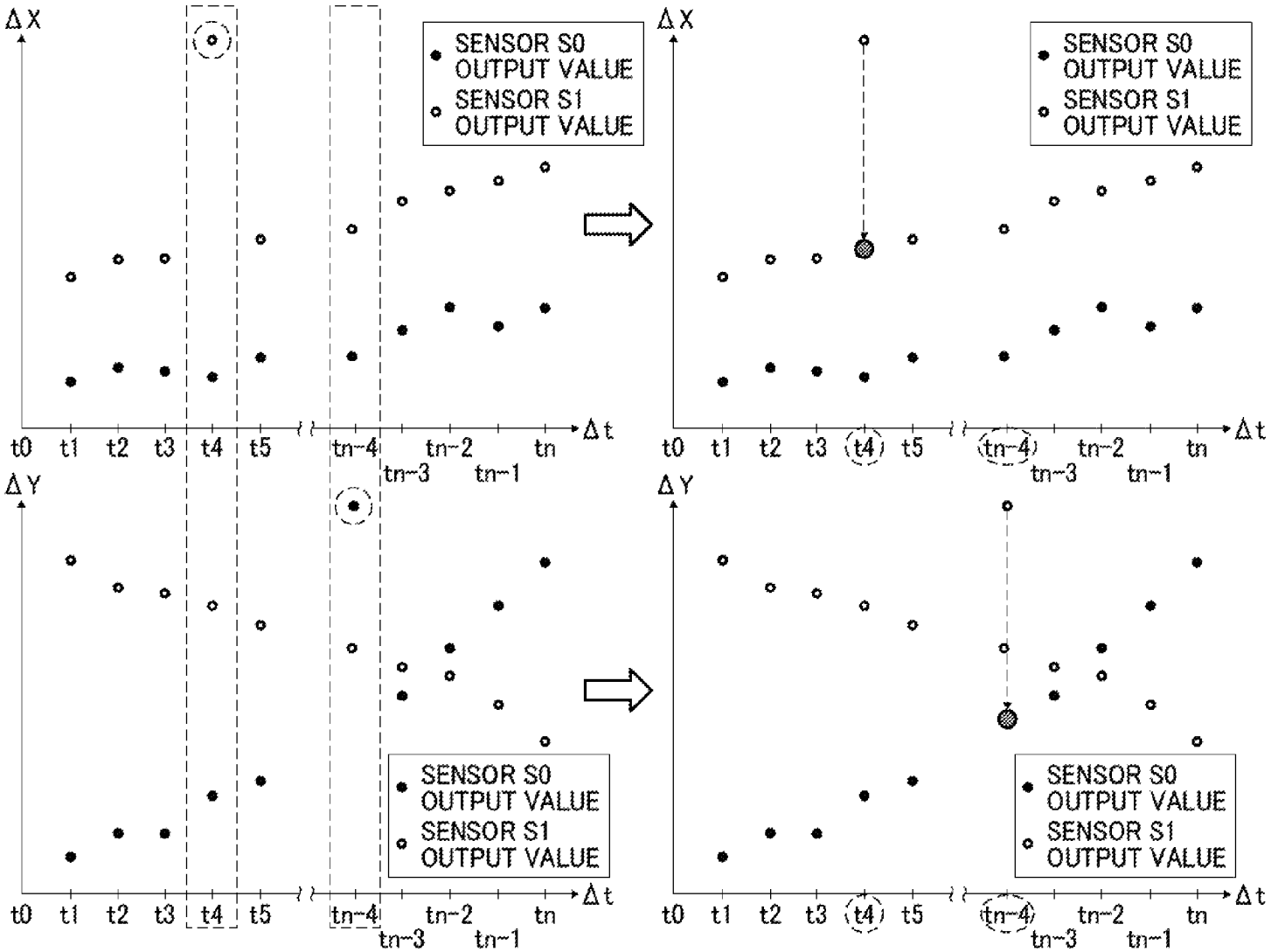
FIG. 14 is a diagram for describing a correction method in the case where only one of output values of the two sensors at the same sampling time point includes noise.

FIG. 14 is a diagram for describing a correction method in the case where only one of the output values of the two sensors at the same sampling time point includes noise. In FIG. 14, an output value in the X-axis direction of the sensor S0 is indicated by a black circle, and an output value in the Y-axis direction of the sensor S1 is indicated by a white circle.

When the above-described |L−Ls| exceeds the noise tolerance, if it is determined that clearly only one of the output value (dx, dy) of the sensor S0 and the output value (dx', dy') of the sensor S1 at the same sampling time point includes noise, correction is performed using the sensor-to-sensor mounting distance L.

When it is clear that only one of the output values (x, y) from the two sensors S0 and S1 includes noise, the sensor output value that clearly includes noise can be calculated back from the sensor output value including no noise, by using equation (4) including the sensor-to-sensor distance Ls calculated on the basis of the output values and the sensor-to-sensor mounting distance L.

As illustrated on the right side of FIG. 14, the sensor output value that clearly includes noise can be calculated by substituting the necessary sensor output values and the mounting distance L into equation (4) described above.

When correction is performed by replacing the sensor output value including noise with the sensor output value calculated as above, the sensor output value including noise can be accurately corrected.

Regarding this correction method, the user may be allowed to select whether to perform correction by using the operation unit 27, thereby improving the usability.

Figure 15:
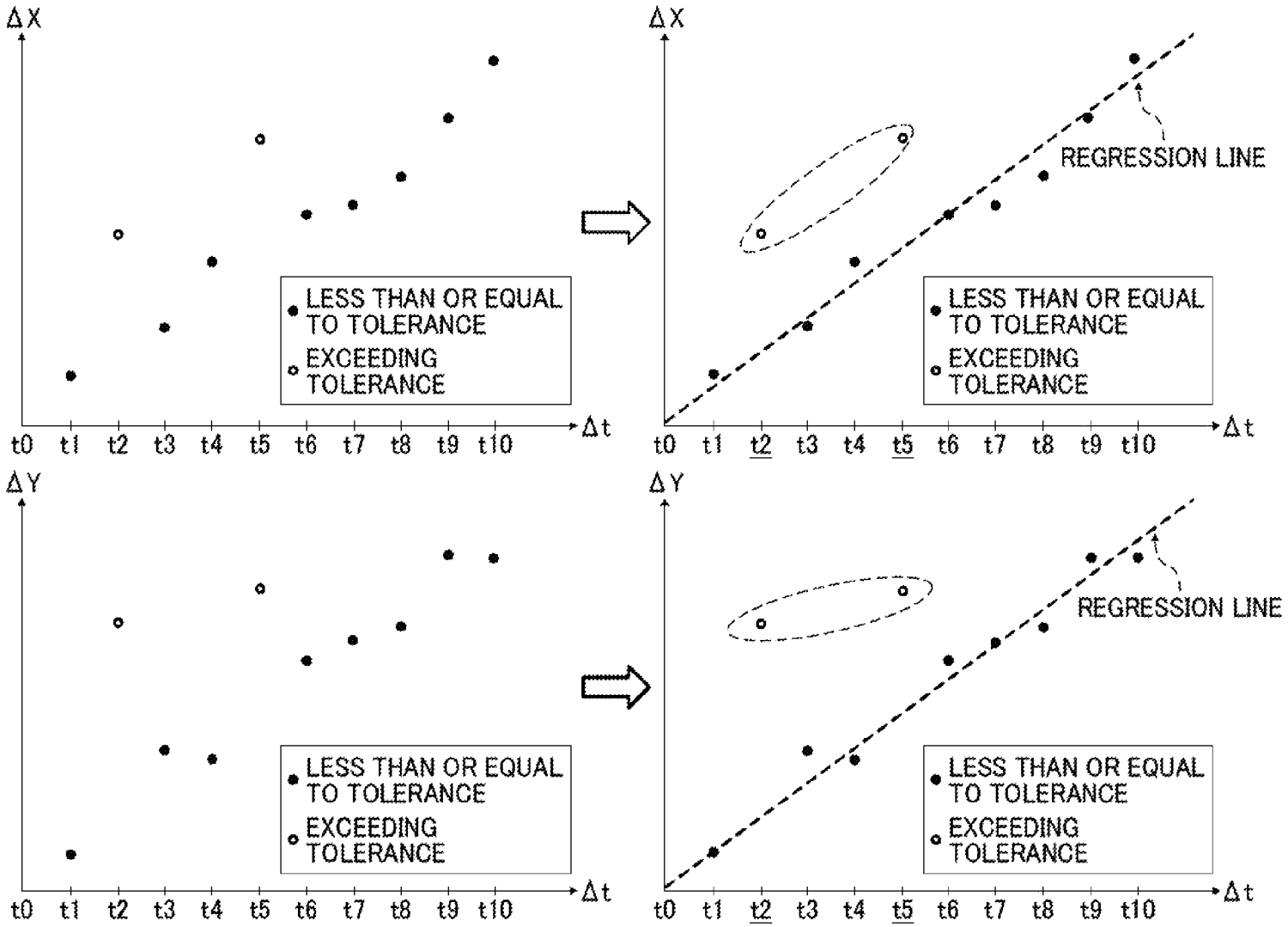
FIG. 15 is a diagram for describing a position function using the sensor output values of the navigation sensors.

FIG. 15 is a diagram for describing a position function using the sensor output values of the navigation sensors.

The left side of FIG. 15 illustrates changes in every sampling period in the X-axis and Y-axis directions of the output value of one navigation sensor (sensor S0 or S1).

The right side of FIG. 15 illustrates a regression line formed by the least squares method using the sensor output values in the case where the above-described |L−Ls| is less than or equal to the noise tolerance.

That is, a regression line (curve) is calculated by the least squares method using the sensor output values in the case where the above-described |L−Ls| is less than or equal to the noise tolerance for a certain number of times. Using the calculated position function, a movement amount up to the certain number of times is calculated, thereby calculating the corrected position information.

Figure 16:
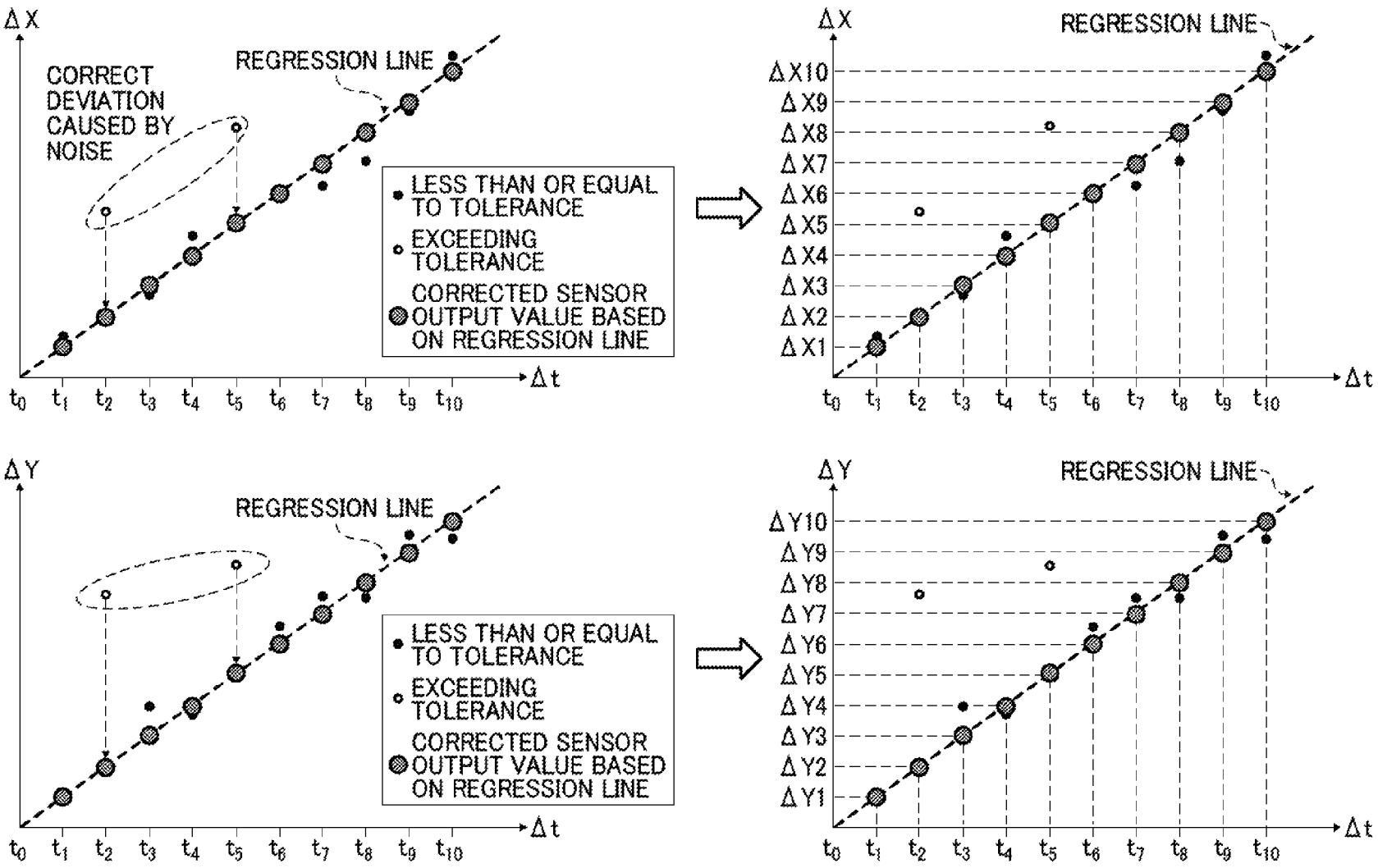
FIG. 16 is a diagram for describing noise-caused deviation correction performed by the position function using the position information on the navigation sensors.

FIG. 16 is a diagram for describing noise-caused deviation correction performed in accordance with the position function using the position information on the navigation sensors.

The left side of FIG. 16 illustrates a position function based on the regression line indicated by a broken line, like the right side of FIG. 15, and an image of correction of deviation of the sensor output values in the case where |L−Ls| exceeds the noise tolerance.

The right side of FIG. 16 illustrates an image of the movement amount at each time point t1 to t10 in accordance with the corrected sensor output value, calculated by the position function based on the regression line indicated by a broken line.

With FIG. 16, a position function using the regression line can be calculated, and an appropriate sensor output value can be obtained. Even a sensor output value in the case where |L−Ls| exceeds the noise tolerance can be corrected for the deviation so as to be close to the true value.

With the position function using the regression line, the corrected sensor output values can be obtained at time points t1 to t10. From the corrected sensor output values, position information ΔX1 to ΔX10 and ΔY1 to ΔY10 at time points t0 to t10 can be obtained, and the sum of the movement amounts ΔX and ΔY at time points t0 to t10 is as described by equation (5).

$$\text{movement } \textit{amounts} \text{ at } t0 \Longrightarrow t10 = \sum_{n=1}^{10} \Delta X_n, \sum_{n=1}^{10} \Delta Y_n \tag{5}$$

When the number of times sampling is performed reaches the certain number as described above, the position calculating circuit 43 illustrated in FIG. 3 calculates a position function using the least squares method by using output values determined by the noise reduction processor 46 not to include noise at the sampling time points so far. The position calculating circuit 43 calculates the corrected position information using the position function, and, using the corrected position information, determines the position information by calculating amounts of movement of the recording head 28 from the reference point until the number of times sampling is performed reaches the certain number.

Figure 17:
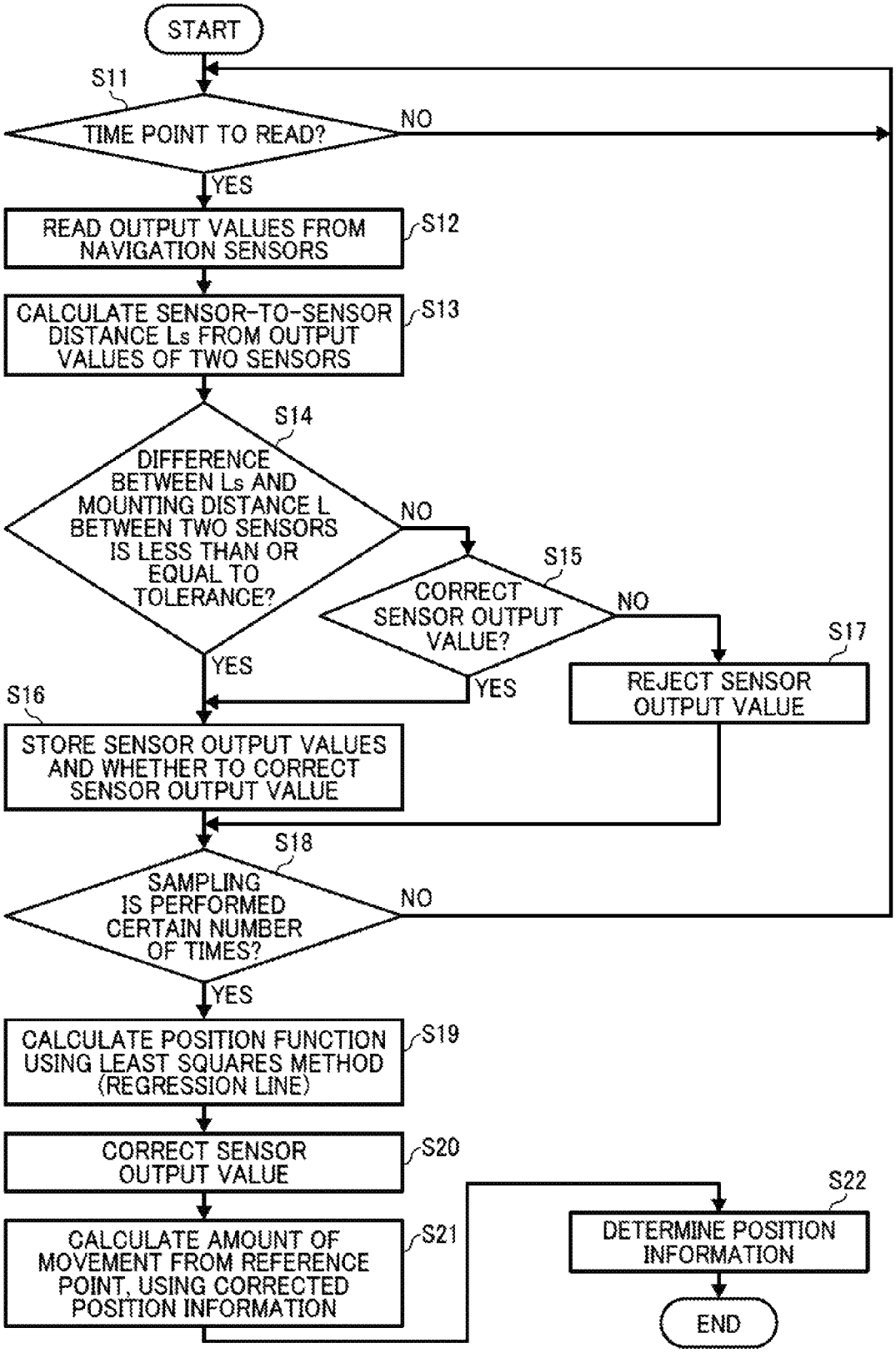
FIG. 17 is a flowchart illustrating the flow of a noise reduction and position information determination operation using the correction and calculation method illustrated in FIG. 16, which is performed by the handheld printer according to the embodiment.

FIG. 17 is a flowchart illustrating the flow of a noise reduction and position information determination operation using the correction and calculation method illustrated in FIG. 16, which is performed by the handheld printer according to the embodiment.

This operation is executed by the software controller 40 illustrated in FIG. 3 under control of the CPU 41.

The flowchart illustrated in FIG. 17 indicates description of noise reduction after output values from the navigation sensors are read. The flowchart also indicates an operation in which, in order to obtain the amount of movement until the number of times reaches a certain number from position information serving as a reference, a position function is calculated using the least squares method using position information from the sensors, and a corrected position function is calculated from the position function.

When the software controller 40 starts the operation illustrated in FIG. 17, in step S11, the software controller 40 causes the timing generating circuit 52 to measure time, and waits until a preset read time point comes. When it becomes a time point to perform reading, the operation proceeds to step S12, and output values from the sensors S0 and S1, which are the navigation sensors 25, are read.

Next, the software controller 40 calculates a distance Ls between the two sensors S0 and S1 in step S13. In step S14, it is determined whether the difference |L−Ls| between the calculated distance Ls and the mounting distance L between the two sensors S0 and S1 is less than or equal to the tolerance.

As a result, when |L−Ls| is less than or equal to the tolerance, the software controller 40 determines that the read sensor output values include no noise, stores in step S16 the sensor output values and information indicating not to correct the sensor output values, and proceeds to step S18. When |L−Ls| is not less than or equal to the tolerance (exceeds the tolerance), it is determined that one of the read sensor output values includes noise. In step S15, it is determined whether to correct that sensor output value by performing comparison with a threshold.

As a result, when it is determined to correct the sensor output value, the software controller 40 stores in step S16 the sensor output values and information indicating correction is to be performed, and proceeds to step S18. When it is determined not to correct the sensor output value, the software controller 40 rejects the sensor output value in step S17, and proceeds to step S18.

In step S18, the software controller 40 determines whether the number of times is a certain number, and returns to step S11 and repeats the above operation until the number of times reaches the certain number.

In the case where it is determined in step S18 that the number of times is the certain number, a position function is calculated in step S19 using the least means square (regression line) using the sensor output values in the case where |L−Ls| is less than or equal to the tolerance. In step S20, a sensor output value subject for correction is corrected by calculating corrected position information using the position function calculated in step S19.

Thereafter, in step S21, using the corrected position information, the software controller 40 calculates the movement amount of the recording head 28 by adding up the amounts of movement of the recording head 28 from the reference point until the number of times sampling is performed reaches the certain number.

Next, in step S22, the software controller 40 determines the position information on the recording head 28 using the calculated movement amount, and stores the position information in the memory. Then, this operation ends, and the software controller 40 repeats the above-described operation.

In the case of using another method of determining and correcting a sensor output value including noise, the method can be implemented by the software controller 40 by executing the above operation with partial changes.

As has been described above, according to the embodiment, even in the case where position information from one of the navigation sensors includes noise, the handheld recording device can obtain the correct position information.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

The invention claimed is:

1. A handheld recording device comprising:

a recording head including a plurality of nozzles;

at least two navigation sensors arranged at a predetermined mounting distance in a direction in which the plurality of nozzles are arranged;

a timing generating circuit configured to generate a timing signal with a predetermined sampling period while the handheld recording device is scanning a recording medium;

a controller configured to read output values of the two navigation sensors every time the timing signal is generated, determine whether the output values include noise based on the output values and the mounting distance between the two navigation sensors, remove noise from the output values when it is determined that at least one of the output values includes noise, calculate an amount of movement of the recording head from a reference point to determine position information of the recording device, based on the output values from which noise has been removed; and calculate a distance (Ls) between the two navigation sensors based on the read output values read from the two navigation sensors, and the mounting distance (L), and determine that the output values include no noise when a difference (|L−Ls|) between the calculated distance (Ls) and the mounting distance (L) is less than or equal to a noise tolerance, and determine that at least one of the output values includes noise when the difference (|L−Ls|) exceeds the noise tolerance; and a drive circuit configured to drive the plurality of nozzles to eject ink to perform recording on the recording medium in accordance with image data and the determined position information.

2. The handheld recording device according to claim 1, wherein, when the controller determines that at least one of the output values includes noise, the controller rejects both of the output values to remove noise from the output values.

3. The handheld recording device according to claim 1, wherein, when the controller determines that at least one of the output values includes noise, the controller corrects both of the output values to remove noise from the output values.

4. The handheld recording device according to claim 1, wherein, when the difference (|L−Ls|) exceeds the noise tolerance, the controller determines that at least one of the read output values that exceeds an average of the output values having the difference (|L−Ls|) exceeding the noise tolerance includes noise.

5. The handheld recording device according to claim 1, wherein the controller replaces the at least one output value determined to include noise with an immediately-preceding output value determined not to include noise in prior sampling.

6. The handheld recording device according to claim 1, wherein the controller replaces at least one output value determined to include noise with an average of output values determined not to include noise obtained in a predetermined number of sampling times.

7. The handheld recording device according to claim 1, wherein the controller sets the noise tolerance and a noise correction threshold, the noise correction threshold being greater than the noise tolerance, and the controller rejects both of the read output values read from the two navigation sensors when the difference (|L−Ls|) exceeds the noise tolerance and is less than or equal to the noise correction threshold, and corrects the read output values when the difference (|L−Ls|) exceeds the noise correction threshold.

8. The handheld recording device according to claim 1, wherein, when the controller successively determines that an output value includes noise for one of the navigation sensors for a predetermined number of times, the controller performs at least one of: notifying a user of an error; and notifying a user of an error and stopping a recording operation being performed by the recording device.

9. The handheld recording device according to claim 1, wherein, when a number of sampling times being performed reaches a predetermined number of sampling times, the controller is configured to calculate a position function using a least squares method by using the output values determined not to include noise, calculate corrected position information using the position function, and using the corrected position information, calculate amounts of movement of the recording head from the reference point for a time period until the number of sampling times being performed reaches the predetermined number of sampling times, to determine the position information of the handheld recording device.

10. A method of detecting a position of a handheld recording device, the method comprising:

generating a timing signal with a predetermined sampling period while the handheld recording device is scanning a recording medium;

reading output values of at least two navigation sensors of the handheld recording device every time the timing signal is generated, the two navigation sensors being arranged at a predetermined mounting distance;

determining whether the output values include noise based on the output values and the mounting distance between the two navigation sensors;

removing noise from the output values when it is determined that at least one of the output values includes noise;

calculating an amount of movement of a recording head of the recording device from a reference point to determine position information of the recording device, based on the output values from which noise has been removed; and calculating a distance (Ls) between the two navigation sensors based on the read output values read from the two navigation sensors, and the mounting distance (L), and determining that the output values include no noise when a difference (|L−Ls|) between the calculated distance (Ls) and the mounting distance (L) is less than or equal to a noise tolerance, and determining that at least one of the output values includes noise when the difference (|L−Ls|) exceeds the noise tolerance; and driving a plurality of nozzles of the recording head to eject ink to perform recording on the recording medium in accordance with image data and the determined position information.

11. A non-transitory recording medium which, when executed by one or more processors, cause the processors to perform a method of detecting a position of a handheld recording device, the method comprising:

generating a timing signal with a predetermined sampling period while the handheld recording device is scanning a recording medium;

reading output values of at least two navigation sensors of the handheld recording device every time the timing signal is generated, the two navigation sensors being arranged at a predetermined mounting distance;

determining whether the output values include noise based on the output values and the mounting distance between the two navigation sensors;

removing noise from the output values when it is determined that at least one of the output values includes noise;

calculating an amount of movement of a recording head of the recording device from a reference point to determine position information of the recording device, based on the output values from which noise has been removed; and calculating a distance (Ls) between the two navigation sensors based on the read output values read from the two navigation sensors, and the mounting distance (L), and determining that the output values include no noise when a difference (|L−Ls|) between the calculated distance (Ls) and the mounting distance (L) is less than or equal to a noise tolerance, and determining that at least one of the output values includes noise when the difference (|L−Ls|) exceeds the noise tolerance; and driving a plurality of nozzles of the recording head to eject ink to perform recording on the recording medium in accordance with image data and the determined position information.

* * * * *